US008038482B2

(12) United States Patent
Erickson et al.

(10) Patent No.: US 8,038,482 B2
(45) Date of Patent: Oct. 18, 2011

(54) HIGH SPEED DATA COMMUNICATIONS CONNECTOR WITH REDUCED MODAL CONVERSION

(75) Inventors: Jason Erickson, Mill Creek, WA (US); Jeffrey Alan Poulsen, Edmonds, WA (US)

(73) Assignee: Leviton Manufacturing Co., Inc., Melville, NY (US)

( * ) Notice: Subject to any disclaimer, the term of this patent is extended or adjusted under 35 U.S.C. 154(b) by 0 days.

(21) Appl. No.: 13/030,397

(22) Filed: Feb. 18, 2011

(65) Prior Publication Data

US 2011/0143585 A1 Jun. 16, 2011

Related U.S. Application Data

(62) Division of application No. 12/605,986, filed on Oct. 26, 2009, now Pat. No. 7,909,656.

(51) Int. Cl.
*H01R 24/00* (2006.01)

(52) U.S. Cl. ..... 439/676

(58) Field of Classification Search ..... 439/676, 439/660, 941

See application file for complete search history.

(56) References Cited

U.S. PATENT DOCUMENTS 5,362,257 A * 11/1994 Neal et al. ..... 439/676
5,414,393 A * 5/1995 Rose et al. ..... 333/1
5,571,035 A * 11/1996 Ferrill ..... 439/894
5,911,602 A * 6/1999 Vaden ..... 439/676
5,961,354 A * 10/1999 Hashim ..... 439/676
5,997,358 A * 12/1999 Adriaenssens et al. ..... 439/676
6,186,834 B1 * 2/2001 Arnett et al. ..... 439/676
6,270,381 B1 * 8/2001 Adriaenssens et al. ..... 439/676
6,443,776 B2 * 9/2002 Reichle ..... 439/676
6,443,777 B1 * 9/2002 McCurdy et al. ..... 439/676
6,464,529 B1 * 10/2002 Jensen et al. ..... 439/405
6,558,204 B1 * 5/2003 Weatherley ..... 439/676

(Continued)

FOREIGN PATENT DOCUMENTS

WO W02010/104968 9/2010

OTHER PUBLICATIONS

European Search Report, Application No. EP10188634, Apr. 8, 2011.

(Continued)

*Primary Examiner* — Tulsidas Patel
*Assistant Examiner* — Vladimir Imas
(74) *Attorney, Agent, or Firm* — Davis Wright Tremaine LLP; George C. Rondeau, Jr.; Heather M. Colburn

(57) ABSTRACT

A plug including first, second, third, and fourth pairs of contacts connected to first, second, third, and fourth wire pairs, respectively. The first pair of contacts is positioned between first and second contacts of the third pair of contacts, the second pair of contacts is positioned alongside the first contact, and the fourth pair of contacts is positioned alongside the second contact. A first and second capacitive coupling member each including a sleeve and contact member are spaced from the plug contacts. The second wire pair extends through the sleeve of the first coupling member and the contact member of the first coupling member is electrically connected to the wire connected to the second contact. The fourth wire pair extends through the sleeve of the second coupling member and the contact member of the first coupling member is electrically connected to the wire connected to the first contact.

13 Claims, 15 Drawing Sheets

U.S. PATENT DOCUMENTS

| | | | | |
|---|---|---|---|---|
| 6,592,395 | B2 * | 7/2003 | Brown et al. | 439/405 |
| 6,764,348 | B2 * | 7/2004 | Han et al. | 439/676 |
| 7,201,618 | B2 * | 4/2007 | Ellis et al. | 439/676 |
| 7,220,149 | B2 * | 5/2007 | Pharney | 439/676 |
| 7,682,203 | B1 * | 3/2010 | Pharney et al. | 439/676 |
| 7,713,094 | B1 * | 5/2010 | Sparrowhawk | 439/676 |
| 7,736,195 | B1 | 6/2010 | Poulsen et al. | |
| 7,909,656 | B1 * | 3/2011 | Erickson et al. | 439/676 |
| 7,914,345 | B2 * | 3/2011 | Bopp et al. | 439/676 |
| 7,927,153 | B2 * | 4/2011 | Straka et al. | 439/676 |
| 2001/0018287 | A1 * | 8/2001 | Reichle | 439/374 |
| 2001/0021608 | A1 * | 9/2001 | Borbolla et al. | 439/676 |
| 2005/0221678 | A1 | 10/2005 | Hammond | |
| 2005/0253662 | A1 | 11/2005 | Seefried | |
| 2005/0254223 | A1 * | 11/2005 | Hashim et al. | 361/793 |
| 2006/0121788 | A1 * | 6/2006 | Pharney | 439/676 |

OTHER PUBLICATIONS

U.S. Appl. No. 12/604,207, filed Oct. 22, 2009, Marti.

* cited by examiner

HIGH SPEED DATA COMMUNICATIONS CONNECTOR WITH REDUCED MODAL CONVERSION

BACKGROUND OF THE INVENTION

1. Field of the Invention

The present invention is generally related to communication plugs and more particularly to communication plugs configured to exhibit reduced levels of modal signal conversion.

2. Description of the Related Art

Conductors that are not physically connected to one another may nonetheless be coupled together electrically and/or magnetically. This creates an undesirable signal in the adjacent conductor referred to as crosstalk.

By placing two elongated conductors (e.g., wires) alongside each other in close proximity (referred to as a "compact pair arrangement"), a common axis can be approximated. If the opposing currents in the conductors are equal, magnetic field "leakage" from the conductors will decrease rapidly as the longitudinal distance along the conductors is increased. If the voltages are also opposite and equal, an electric field primarily concentrated between the conductors will also decrease as the longitudinal distance along the conductors is increased. The compact pair arrangement is often sufficient to avoid crosstalk if other similar pairs of conductors are in close proximity to the first pair of conductors. Twisting the pairs of conductors will tend to negate the residual field couplings and allow closer spacing of adjacent pairs. However, if for some reason the conductors within a pair are spaced far enough apart, undesired coupling and crosstalk may occur.

The structure of many conventional communication connectors (including the RJ-45 type connector) is governed by standards such as FCC part 68 and the TIA/EIA 568 standards. Referring to FIG. 1, a conventional telecommunications connector 10 typically includes a communication plug 20 and a communication jack or outlet 30 configured to receive the plug. The outlet 30 typically provides an access point to a network (not shown), a communications device (not shown), and the like.

As is appreciated by those of ordinary skill in the art, there are two standardized conventions for assigning the wires of the twisted wire pairs to the contacts within the plug and the outlet: T568A and T568B. For all practical purposes, these conventions are identical except that twisted pairs 3 and 2 are interchanged. For illustrative purposes, the T568B convention has been described and illustrated herein.

Each of the plug 20 and the outlet 30 includes a plurality of conductors or contacts. Turning to FIGS. 2 and 3, the plug 20 includes a plurality of conductors or contacts P-T1 to P-T8. Returning to FIG. 1, the outlet 30 includes a plurality of conductors or contacts 32. Within the communication outlet 30, the outlet contacts 32 are positioned in an arrangement corresponding to the arrangement of the plug contacts P-T1 to P-T8 (see FIGS. 2 and 3) in the plug 20. When the plug 20 is received inside the outlet 30, the contacts P-T1 to P-T8 (see FIGS. 2 and 3) of the plug engage correspondingly positioned contacts 32 of the outlet. The plug 20 has a housing 34 with a rearward facing open portion 36 opposite the contacts P-T1 to P-T8 (illustrated in FIGS. 2 and 3).

The communication plug 20 is typically physically connected to one end portion 42 of a communication cable 40, which is inserted inside the plug 20 through the rearward facing open portion 36. Turning to FIG. 3, the cable 40 may be a 4-pair flexible cord, and the plug 20 may be coupled thereto to create a patch cord 50. The cable 40 allows a communications device (not shown) connected thereto to communicate with a network (not shown), a device (not shown), and the like connected to the outlet 30 (see FIG. 1).

A conventional communication cable, such as the cable 40, includes four twisted-wire pairs (also known as "twisted pairs"), which are each physically connected to the plug 20. Following this convention, the contacts P-T1 to P-T8 of the plug 20 are each connected to a different wire (W-1 to W-8) of the four twisted pairs (referred to as "twisted pair 1," "twisted pair 2," "twisted pair 3," and "twisted pair 4" herein). The twisted pair 1 includes wires W-4 and W-5. The twisted pair 2 includes wires W-1 and W-2. The twisted pair 3 includes wires W-3 and W-6. The twisted pair 4 includes wires W-7 and W-8. The twisted pairs 1-4 are housed inside an outer cable sheath 44 typically constructed from an electrically insulating material.

Each of the wires W-1 to W-8 is substantially identical to one another. For the sake of brevity, only the structure of the wire W-1 will be described. Turning to FIG. 4, as is appreciated by those of ordinary skill in the art, the wire W-1 as well as the wires W-2 to W-8 all include an electrical conductor 60 (e.g., a conventional copper wire) surrounded by an outer layer of insulation 70 (e.g., a conventional insulating flexible plastic jacket).

Each of the twisted pairs 1-4 serves as a differential signaling pair wherein signals are transmitted thereupon and expressed as voltage and current differences between the wires of the twisted pair. A twisted pair can be susceptible to electromagnetic sources including another nearby cable of similar construction. Signals received by the twisted pair from such electromagnetic sources external to the cable's jacket are referred to as "alien crosstalk." The twisted pair can also receive signals from one or more wires of the three other twisted pairs within the cable's jacket, which is referred to as "local crosstalk" or "internal crosstalk."

The wires W-1 to W-8 of the twisted pairs 1-4 are connected to the plug contacts P-T1 to P-T8, respectively, to form four differential signaling pairs: a first plug pair 1, a second plug pair 2, a third plug pair 3, and a fourth plug pair 4. The twisted pair 2 (i.e., the wires W-1 and W-2) is connected to the adjacent plug contacts P-T1 and P-T2 to form the second plug pair 2. The twisted pair 4 (i.e., wires W-7 and W-8) is connected to the adjacent plug contacts P-T7 and P-T8 to form the plug pair 4. The twisted pair 1 (i.e., wires W-4 and W-5) is connected to the adjacent plug contacts P-T4 and P-T5 to form the plug pair 1. The twisted pair 3 (i.e., wires W-3 and W-6) is connected to the troublesome "split" plug contacts P-T3 and P-T6 to form the "split" plug pair 3. The plug contacts P-T3 and P-T6 flank the plug contacts P-T4 and P-T5 of the plug pair 1. The plug pairs 2 and 4 are located furthest apart from one another and the plug pairs 1 and 3 are positioned between the plug pairs 2 and 4.

A challenge of the structural requisites of conventional communication cabling standards relates to the fact that the two wires W-3 and W-6 of twisted pair 3 are connected to widely spaced plug contacts P-T3 and P-T6, respectively, which straddle the plug contacts P-T4 and P-T5 to which the two wires W-4 and W-5 of the twisted pair 1 are connected. This places the twisted pair 2 and the twisted pair 4 on either side of the twisted pair 3. This arrangement of the plug contacts P-T1 and P-T8 and their associated wiring can cause the signal transmitted on twisted pair 3 to impart different voltages and/or currents onto the twisted pair 2 and the twisted pair 4 effectively causing differential voltages between the composite of both wires W-1 and W-2 of the twisted pair 2 and the composite of both wires W-7 and W-8 of the twisted pair 4 as an undesired cable mode conversion coupling that unfortunately may enhance alien crosstalk elsewhere, which is referred to hereafter as a "modal launch" or "mode conversion."

In the conventional communication connector 10, the mode of coupling of present concern occurs where the wires W-3 and W-6 of twisted pair 3 are split apart within the plug 20 (i.e., as the wires W-3 and W-6 approach the plug contact P-T3 and P-T6). A significant amount of this type of undesirable coupling also occurs between the plug contacts themselves. This splitting of wires W-3 and W-6 of twisted pair 3, and their associated plug contacts, creates selective capacitive and inductive coupling from the two opposing signals on twisted pair 3, and the increased distance between the wires W-3 and W-6 causes an increase in magnetic coupling between the twisted pair 3 and a first "composite" conductor including the wires W-1 and W-2 (of the twisted pair 2) and a second "composite" conductor including the wires W-7 and W-8 (of the twisted pair 4). In other words, the wires W-1 and W-2 of the twisted pair 2 are treated as a first two-stranded or "composite" wire and the wires W-7 and W-8 of the twisted pair 4 are treated as a second two-stranded or "composite" wire. As a result, a small "coupled" portion of the differential signal originating on twisted pair 3 appears as two opposite common, or "even," mode signals on the first and second "composite" wires.

Thus, where the first and second "composite" wires are treated equally, the signal transmitted on twisted pair 3 may impart opposite voltages and/or currents onto the twisted pair 2 (i.e., the first "composite" wire) and the twisted pair 4 (i.e., the second "composite" wire), which causes differential voltages between the first and second "composite" wires. Thus there is a "launch," of an undesired common mode signal that may increase undesired alien crosstalk elsewhere in the transmission system comprising the plug 20, the outlet 30, and their respective cables (e.g., the cable 40).

The transmission path of the plug 20, the outlet 30, and their respective cables (e.g., the cable 40) can be viewed as including the plug 20 in which some of the conductors are located in close proximity to one another and others are spaced farther apart, the interface between a portion of the plug 20 and a portion of the outlet 30, and the outlet 30 wherein conductors are located in close proximity to one another. This conventional arrangement of the transmission path may cause a "modal launch" that extends from the communication connector 10 into the cable 40 connected to the plug 20 and/or other components connected to the outlet 30.

As discussed above, within the plug 20, the modal launch effectively treats the twisted pair 2 as a single two-stranded "paired" conductor (i.e., the first "composite" wire) that is distantly juxtaposed with the twisted pair 4 as its opposite single two-stranded "paired" conductor (i.e., the second "composite" wire). As a result, a "composite" differential pair is created in a communication cable 40 by the wider spaced apart first and second "composite" wires. The wider spacing of the first and second "composite" wires unfortunately enhances vulnerability and sourcing of unwanted crosstalk among other cables situated in the vicinity, such as in a same cable tray, conduit, etc.

The plug-outlet interface is typically the origin of undesired mode conversion coupling in the communication connector 10. At this location, the wires of the twisted pair 3, the plug contacts P-T3 and P-T6, and the outlet contacts corresponding to the plug contacts P-T3 and P-T6 are spaced apart from one another, and may couple (capacitively and/or inductively) with the other conductors of the communication connector 10. One approach to addressing this capacitive and inductive coupling is to cross the split conductors at the plug-outlet interface, ideally at a location near a midpoint of the plug-outlet interface from which mode conversion coupling occurs. For example, the split conductors may be crossed within the communication outlet 30, the communication plug 20, or both. This approach positions a portion of the wire W-3 adjacent to the twisted pair 4 (i.e., the second "composite" wire) and both capacitively and inductively couples the wire W-3 with the second "composite" wire. At the same time, a portion of the wire W-6 is positioned adjacent to the twisted pair 2 (i.e., the first "composite" wire) to thereby capacitively and inductively couple the wire W-6 with the first "composite" wire.

Unfortunately, this approach can present some drawbacks. In the plug 20, the positioning of the wires W-1 to W-8 as described above may cause certain aspects of the transmission performance of the plug to be noncompliant with the TIA/EIA 568 standards. And, in the outlet 30, crossing the conductors can be physically difficult to implement and may compromise mechanical performance.

Thus, a need exists for communication plugs configured to reduce crosstalk. A plug configured to reduce crosstalk that is compliant with applicable communication plug standards is desirable. A further need exists for a communication connector configured to reduce crosstalk caused by unwanted intermodal coupling between the conducting elements of the connector. The present application provides these and other advantages as will be apparent from the following detailed description and accompanying figures.

BRIEF DESCRIPTION OF THE SEVERAL VIEWS OF THE DRAWING(S)

Figure 7:
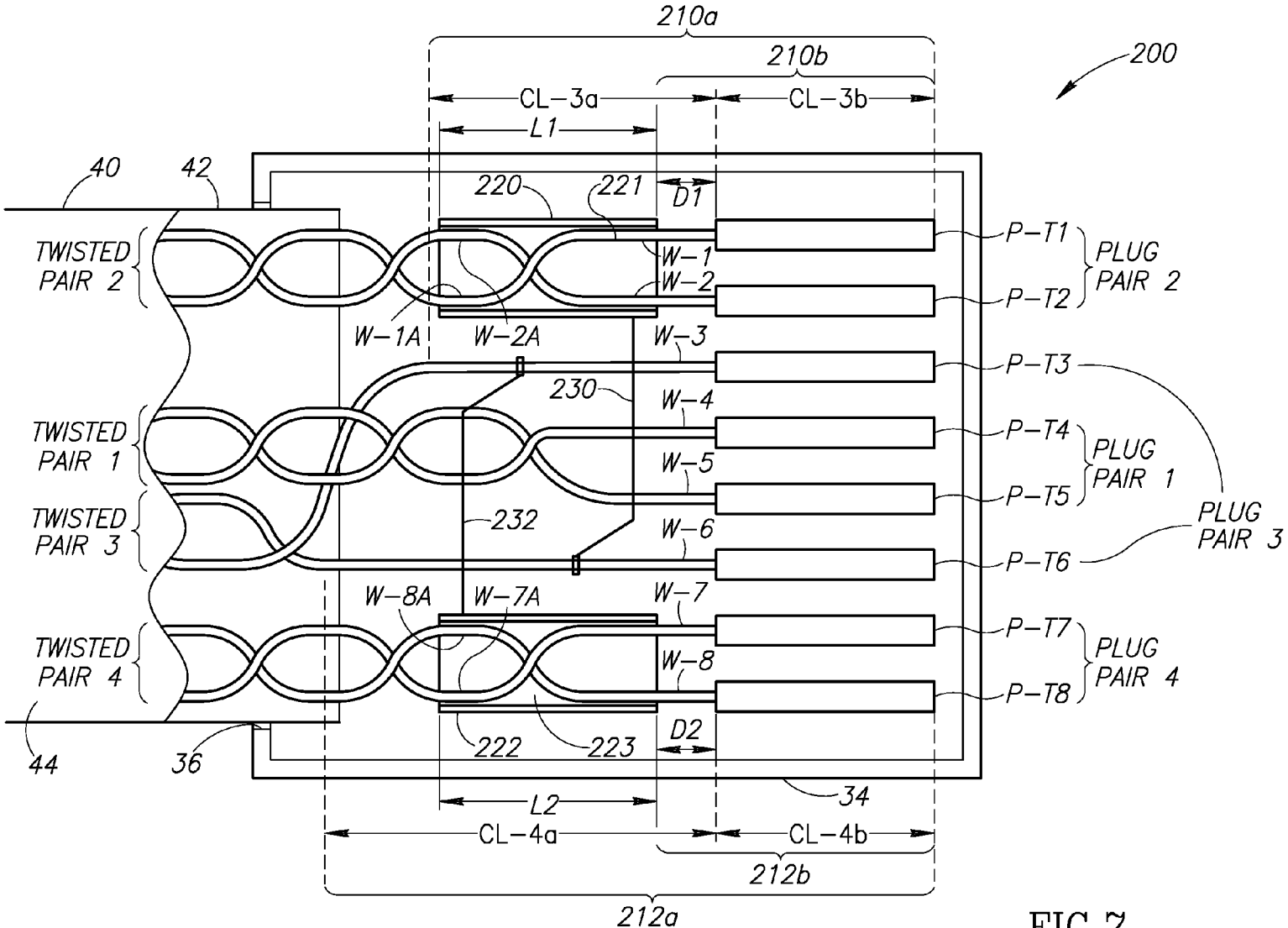
FIG. 7 is a schematic illustrating a first embodiment of the communication plug of FIG. 6.
Figure 8:
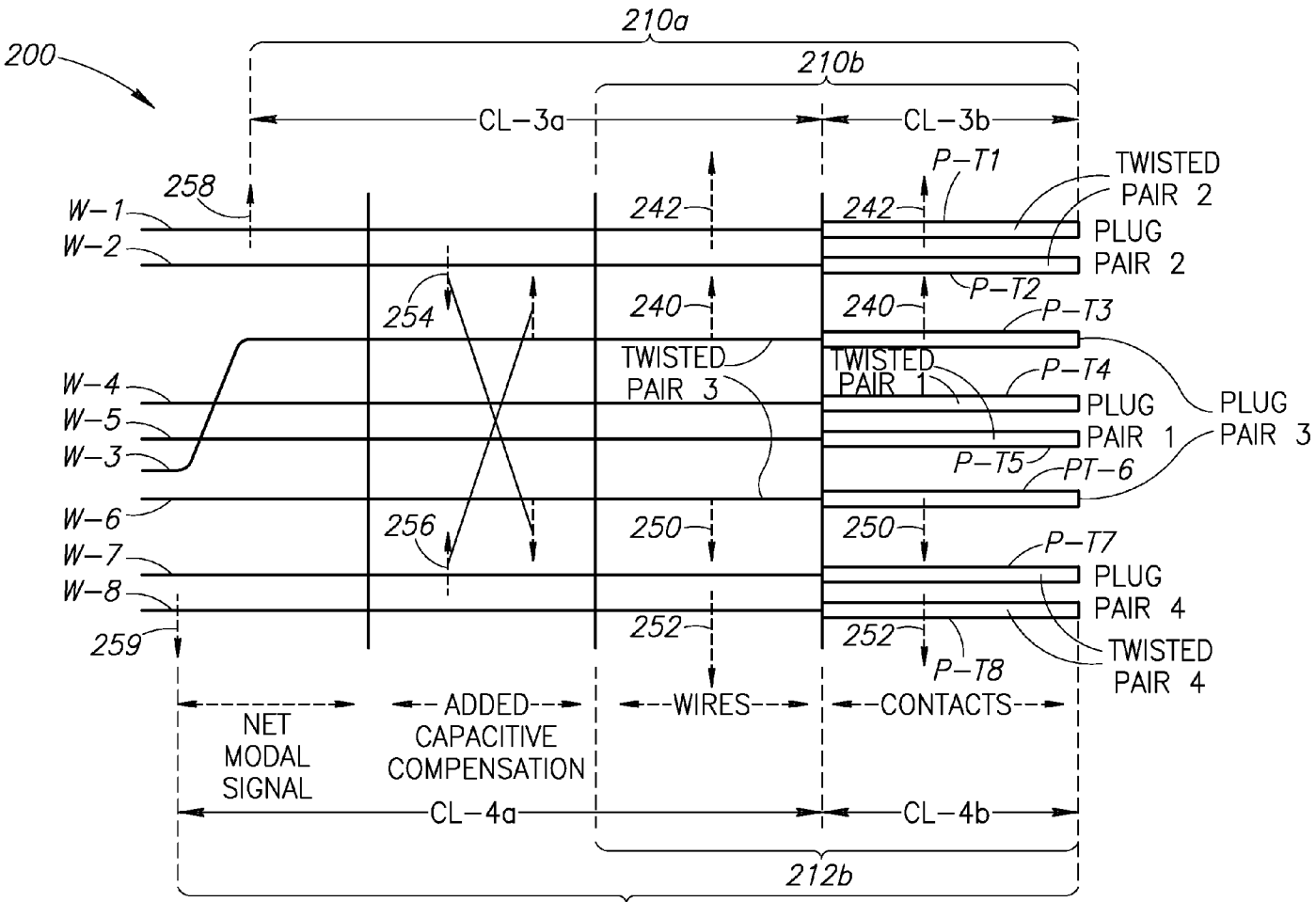

FIG. 8 is a vector diagram illustrating signals carried on the wires of a third "split" pair of wires within the communication plug of FIG. 7, offending common mode signals induced on the second pair of wires and the fourth pair of wires, and compensating common mode signals of opposite polarity induced in the second pair of wires and the fourth pair of wires that at least partially cancel the offending common mode signals.

Figure 9:
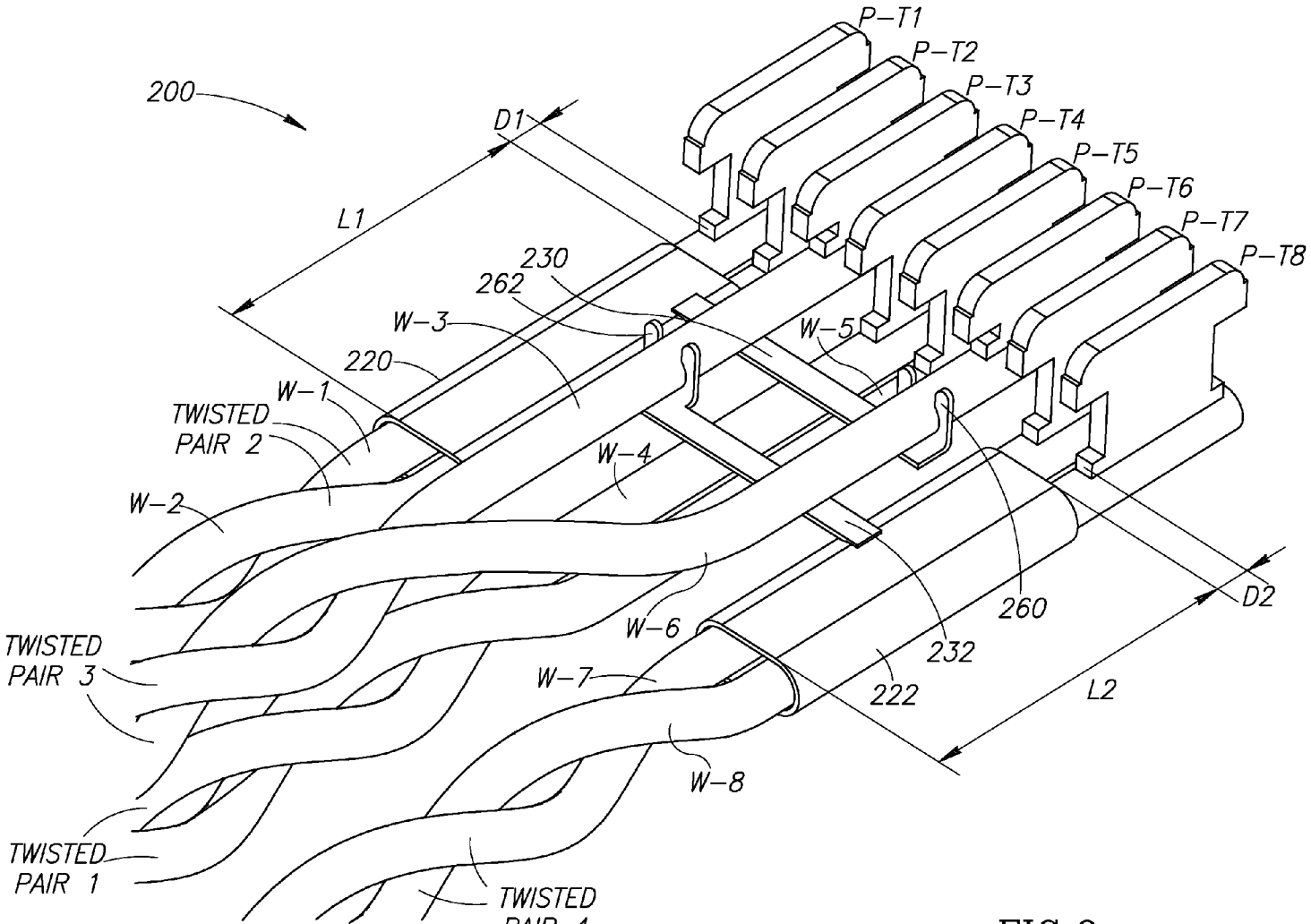

FIG. 9 is a perspective view of the communication plug of FIG. 7 configured to include insulation displacement connectors.

Figure 10:
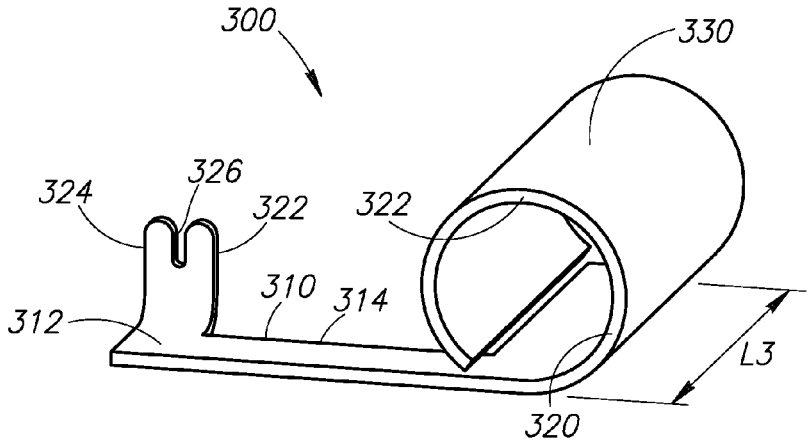

FIG. 10 is a perspective view of a capacitive coupling member.

Figure 11:
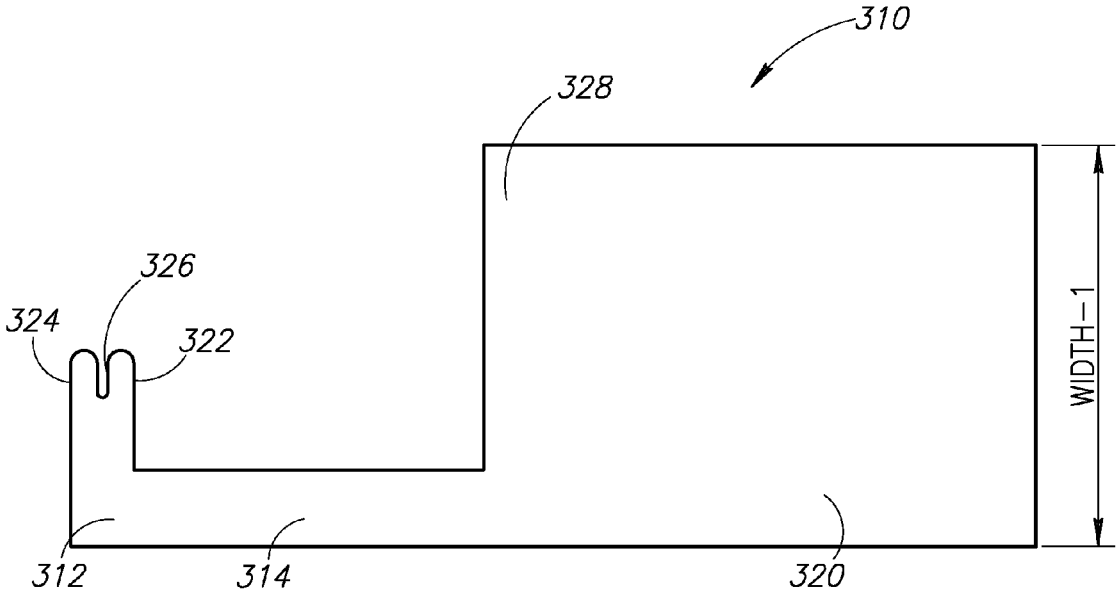

FIG. 11 is a top view of a sheet of electrically conductive material cutout to define the capacitive coupling member of FIG. 10.

Figure 12:
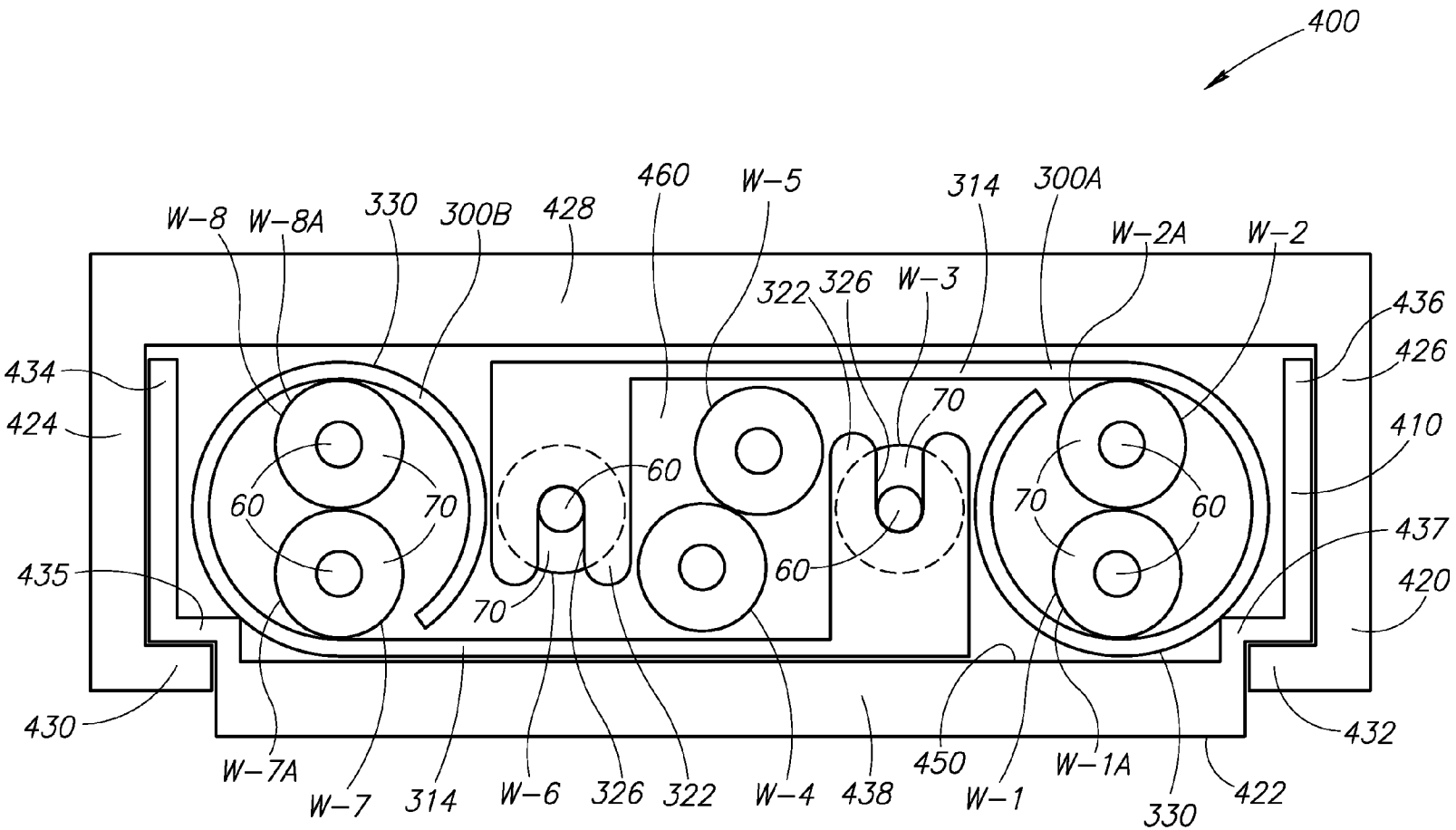

FIG. 12 is a cross-sectional view of a wire management device including a pair of the capacitive coupling members of FIG. 10 and illustrated with the wires of the cable disposed therein.

Figure 13:
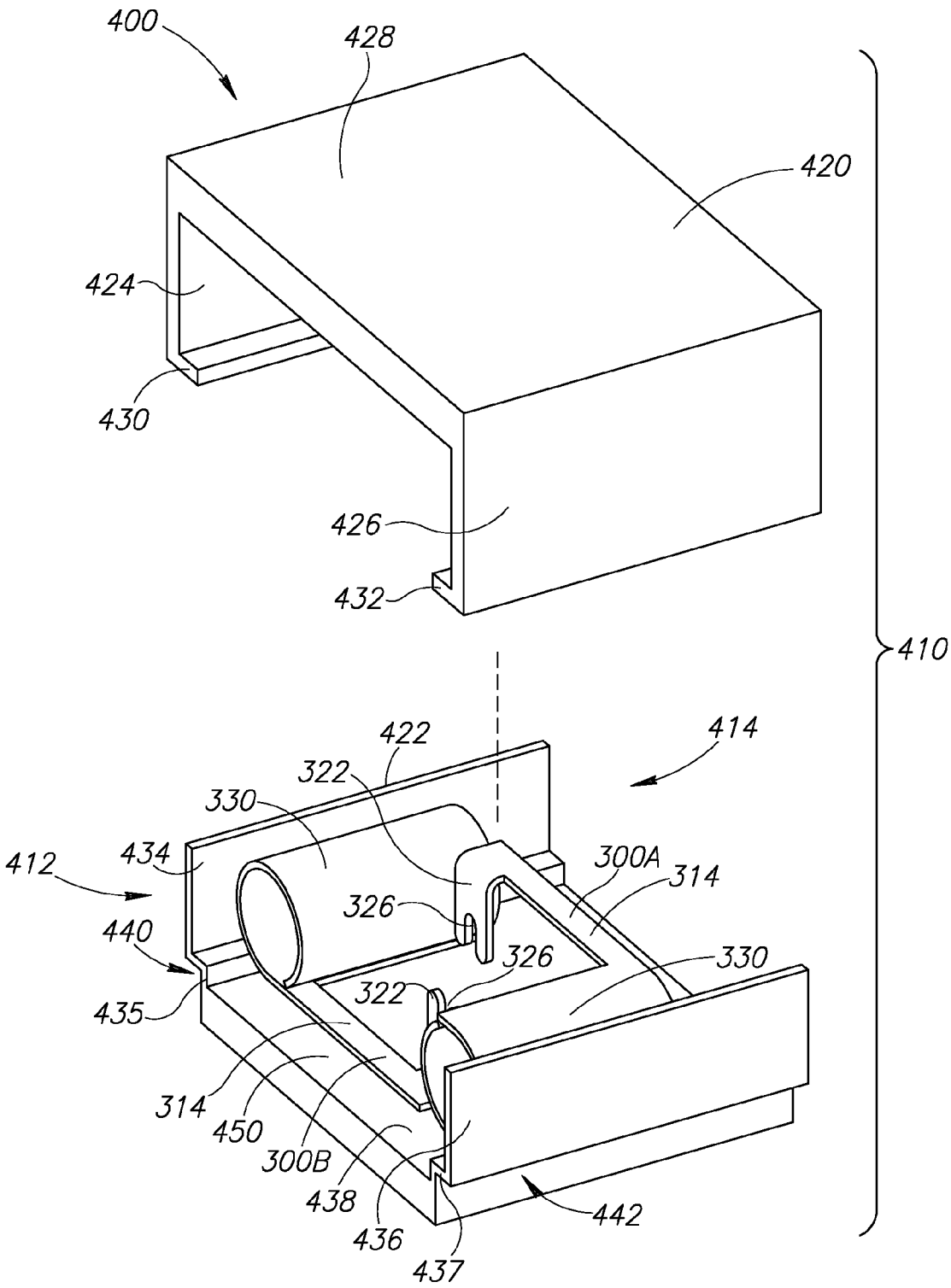

FIG. 13 is an exploded perspective view of the wire management device of FIG. 12.

Figure 14:
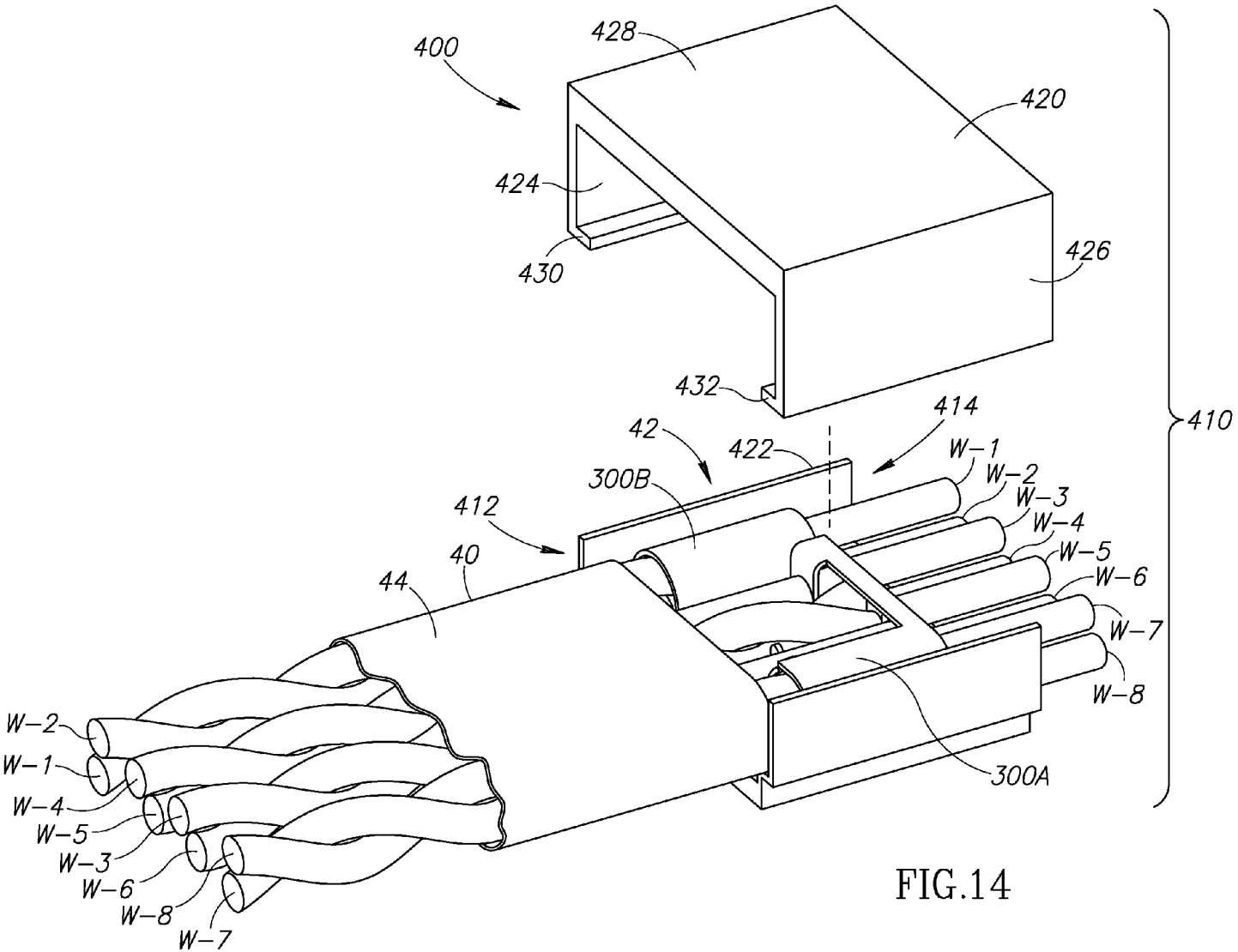

FIG. 14 is an exploded perspective view of the wire management device of FIG. 12 illustrated with the wires of the cable disposed therein.

Figure 15:
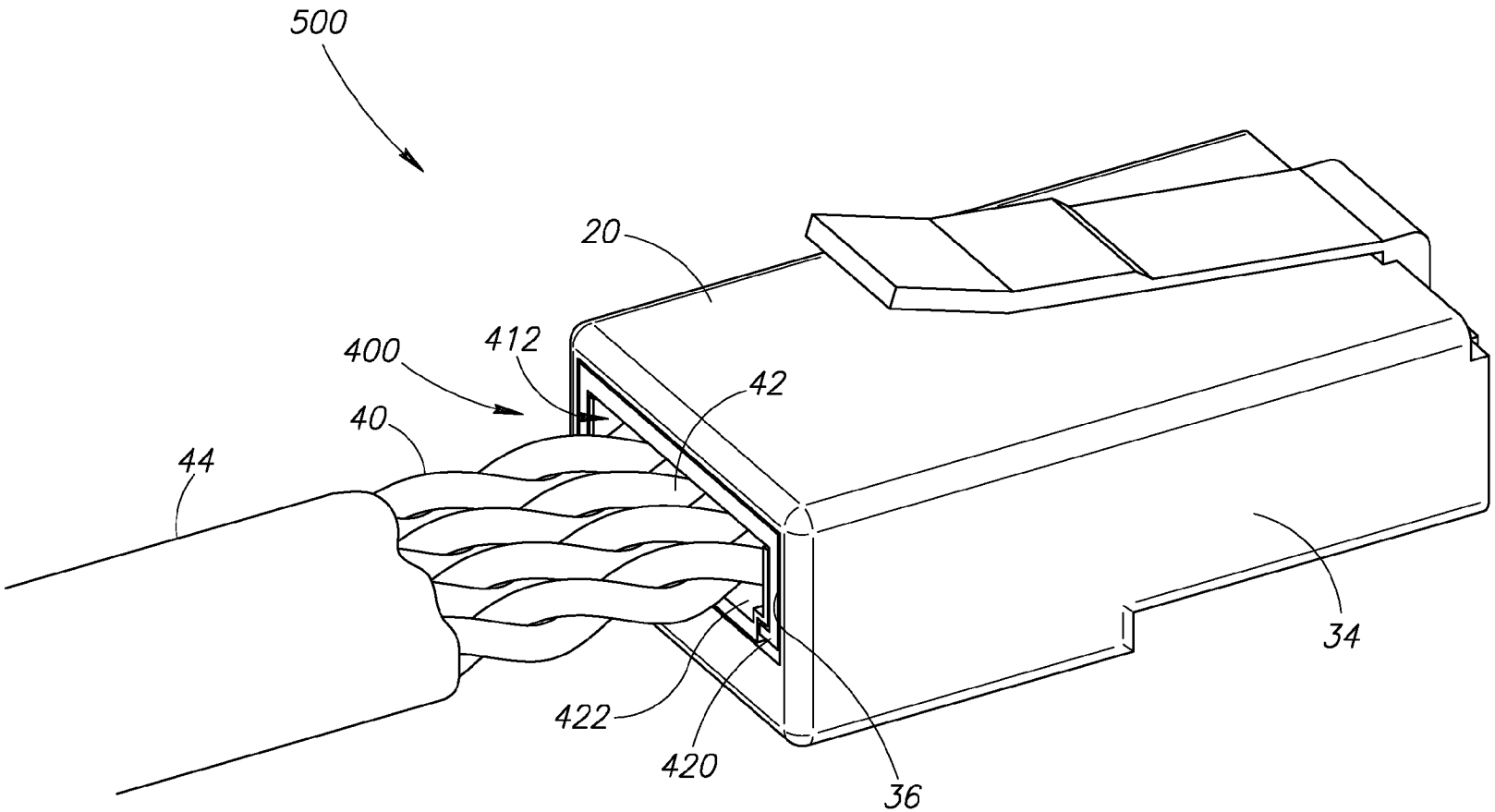

FIG. 15 is a perspective view of a first embodiment of a plug assembly incorporating the wire management device of FIG. 12 illustrated with the wires of the cable disposed therein.

Figure 2:
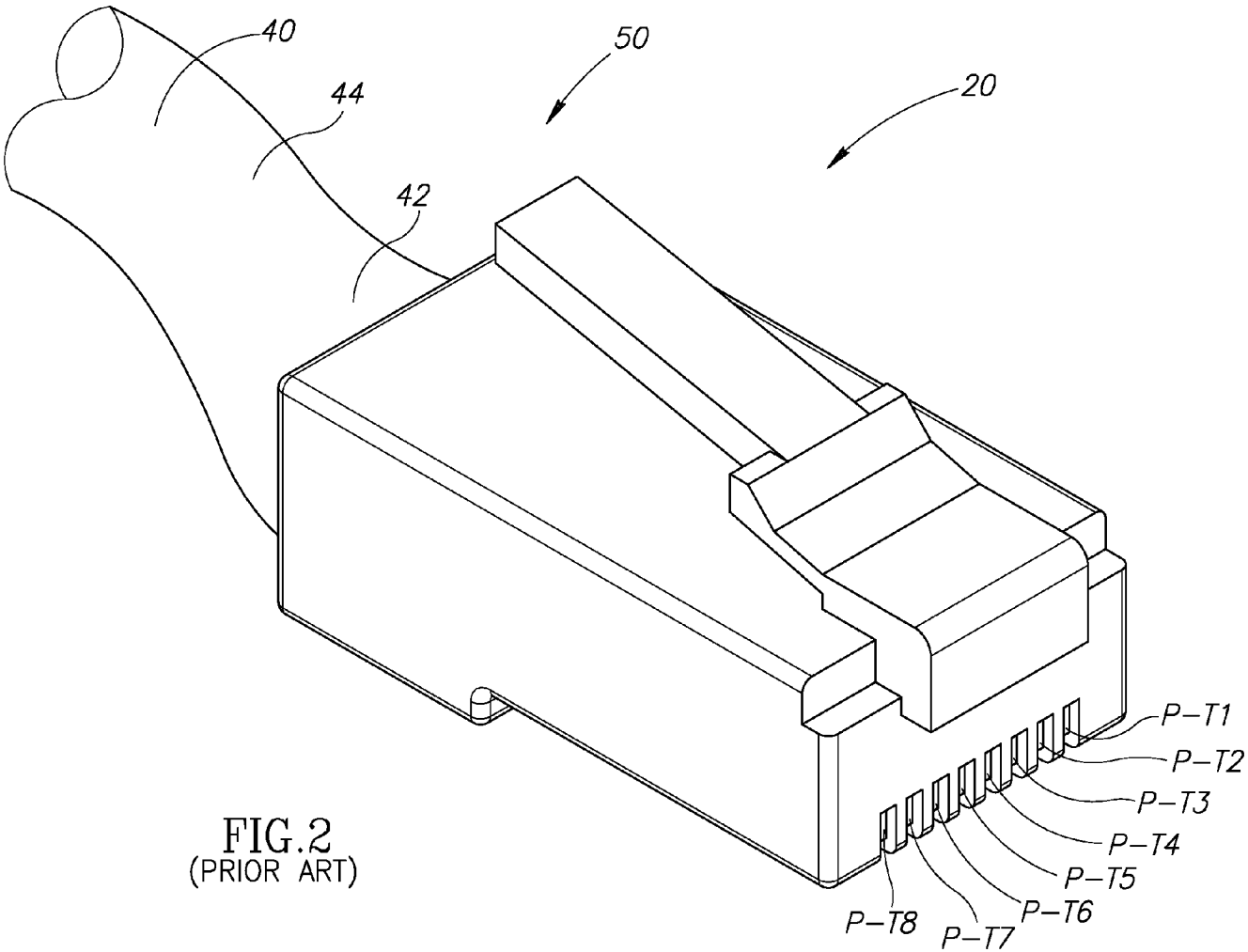
FIG.2 (PRIOR ART)
FIG. 2 is a perspective view of the communication plug and the cable of the telecommunications connector of FIG. 1.
Figure 6:
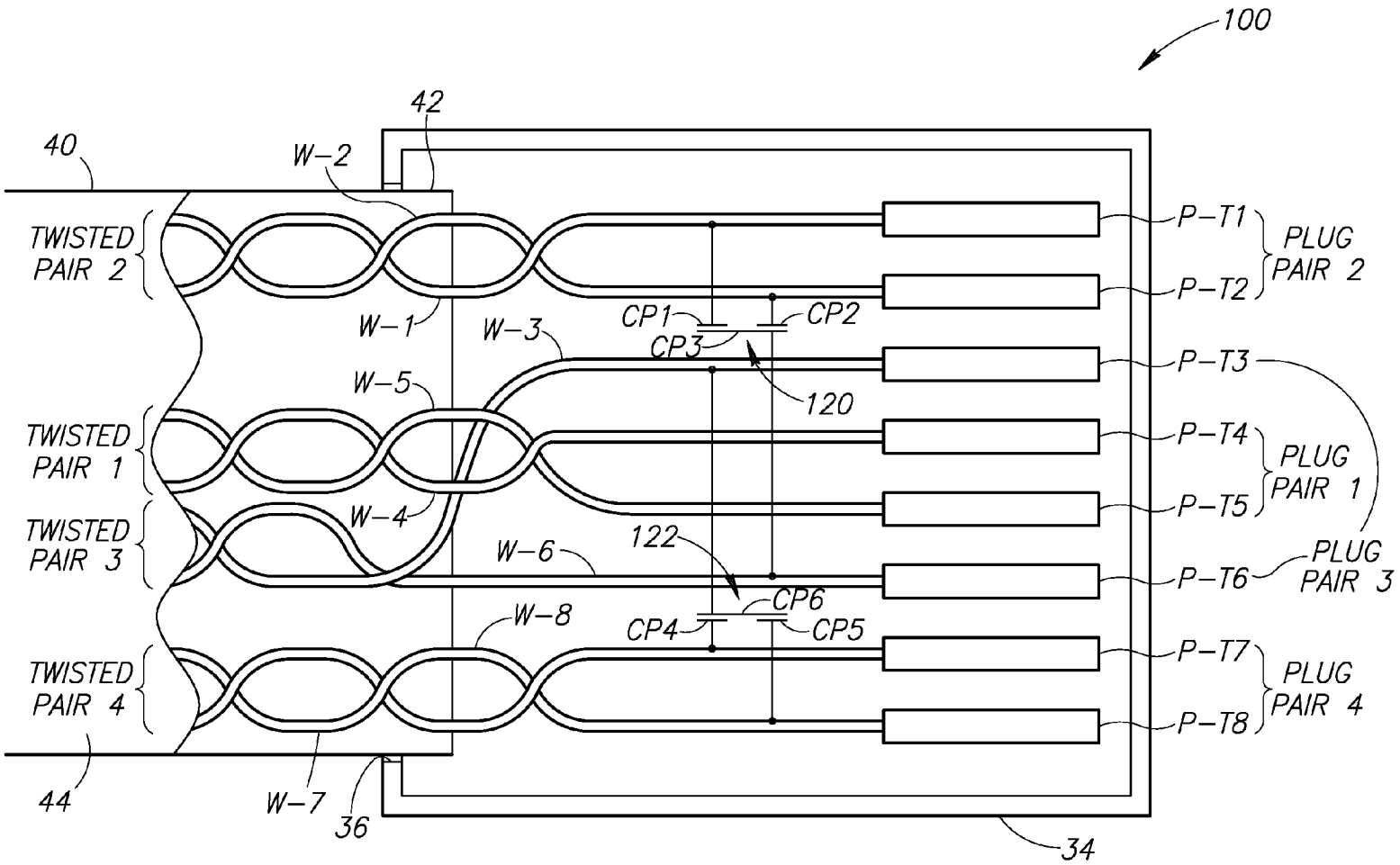
FIG. 6 is a schematic illustrating a communication plug configured to have reduced modal conversion through the application of capacitive compensation without using inductive compensation.
Figure 16:
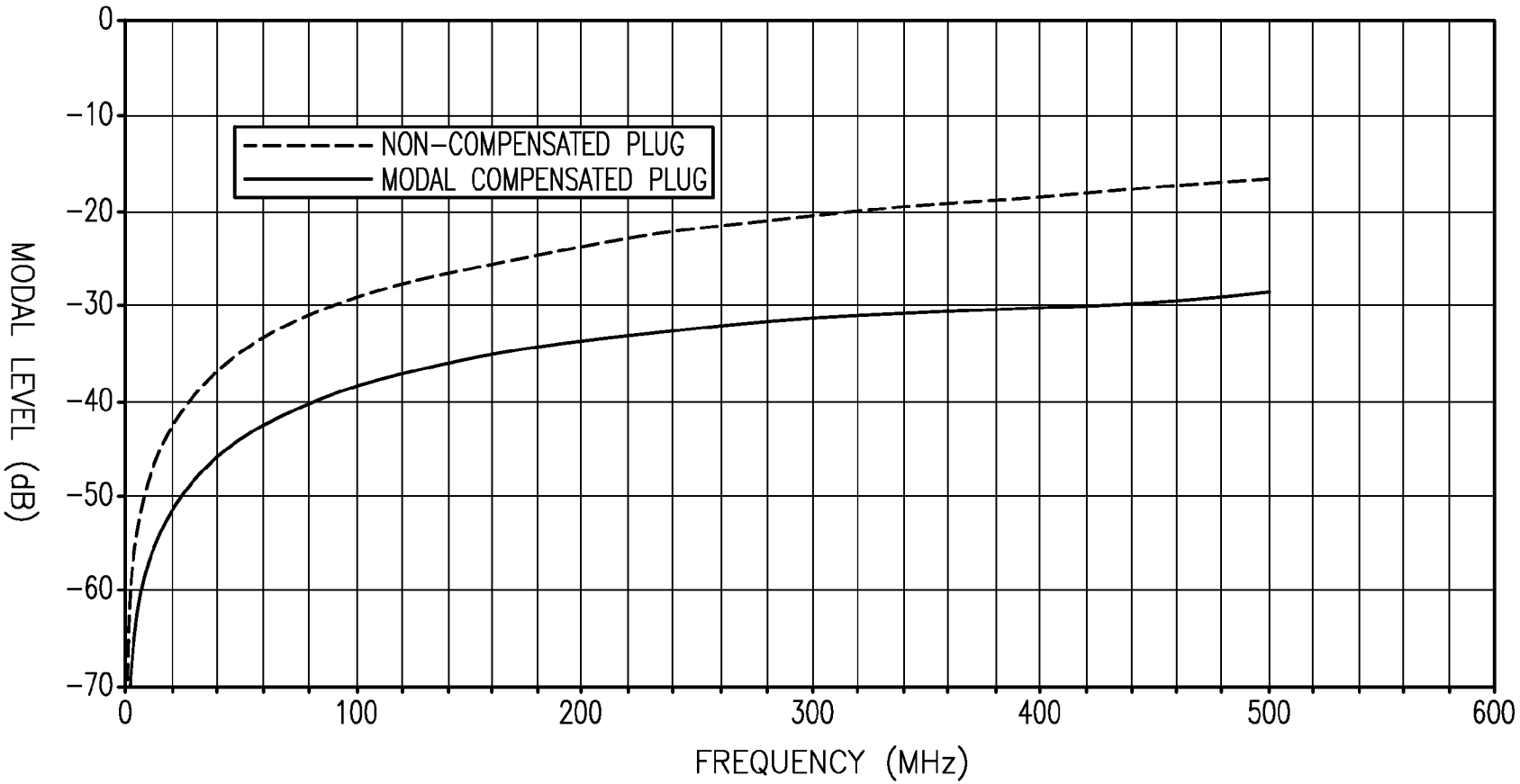

FIG. 16 is a graph of an amount of modal conversion measured in the prior art communication plug of FIG. 2 compared with an amount of modal conversion measured in the plug of FIG. 6, which includes capacitive, but not inductive, modal compensation.

DETAILED DESCRIPTION OF THE INVENTION

As is appreciated by those of ordinary skill in the art, there are two standardized conventions for assigning the wires of the twisted wire pairs to the contacts within the plug and the outlet: T568A and T568B. For all practical purposes, these conventions are identical except that twisted pairs 3 and 2 are interchanged. For illustrative purposes, the T568B convention has been described and illustrated herein. However, through application of ordinary skill in the art, the present teachings may be applied to the T568A wiring format, as well as to any other arrangement of wires regardless of actual pair number assignments or standards.

Figure 1:
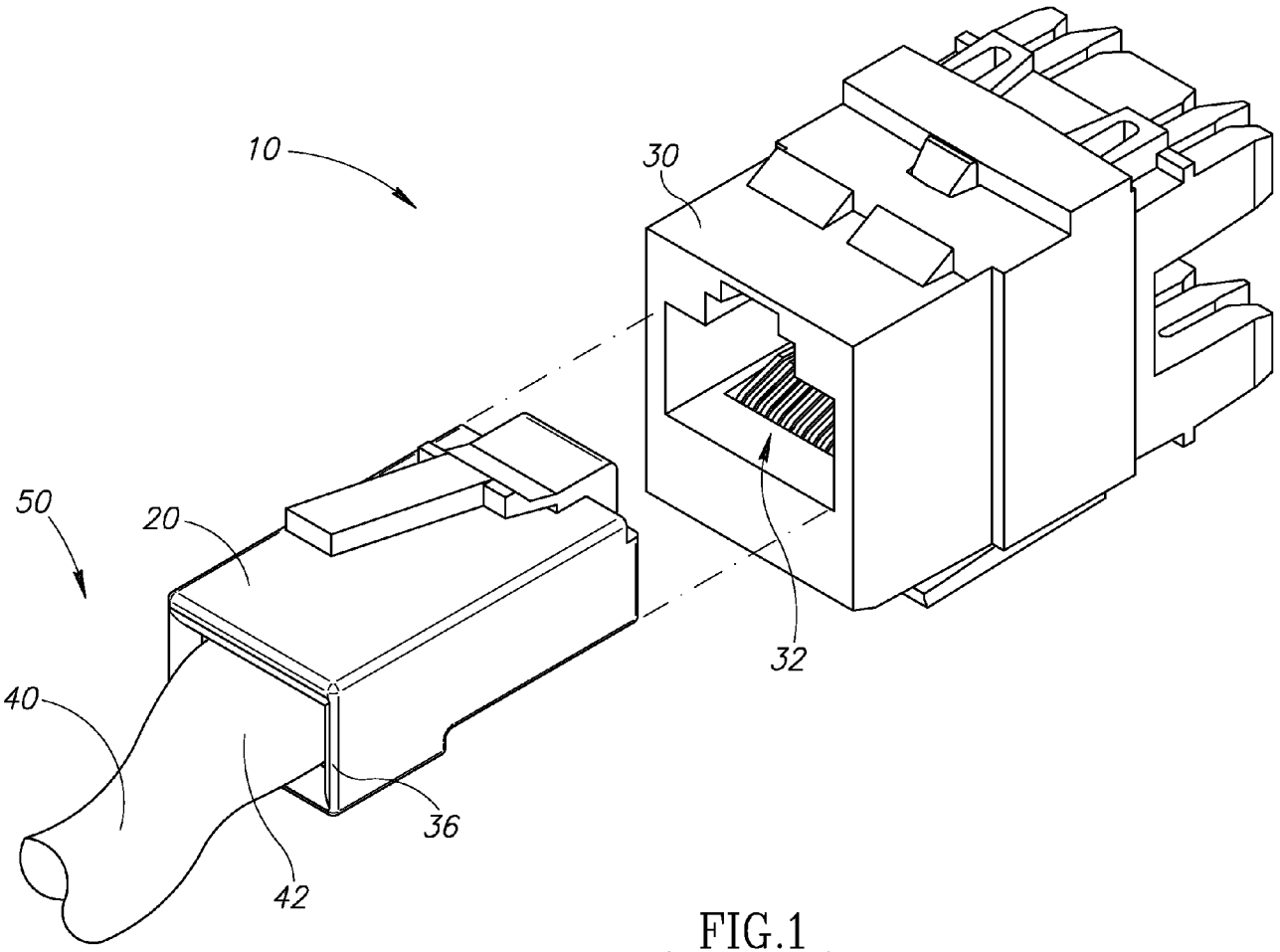
FIG.1 (PRIOR ART)
FIG. 1 is a perspective view of a prior art telecommunications connector including a communication plug terminating a cable and an outlet.
Figure 3:
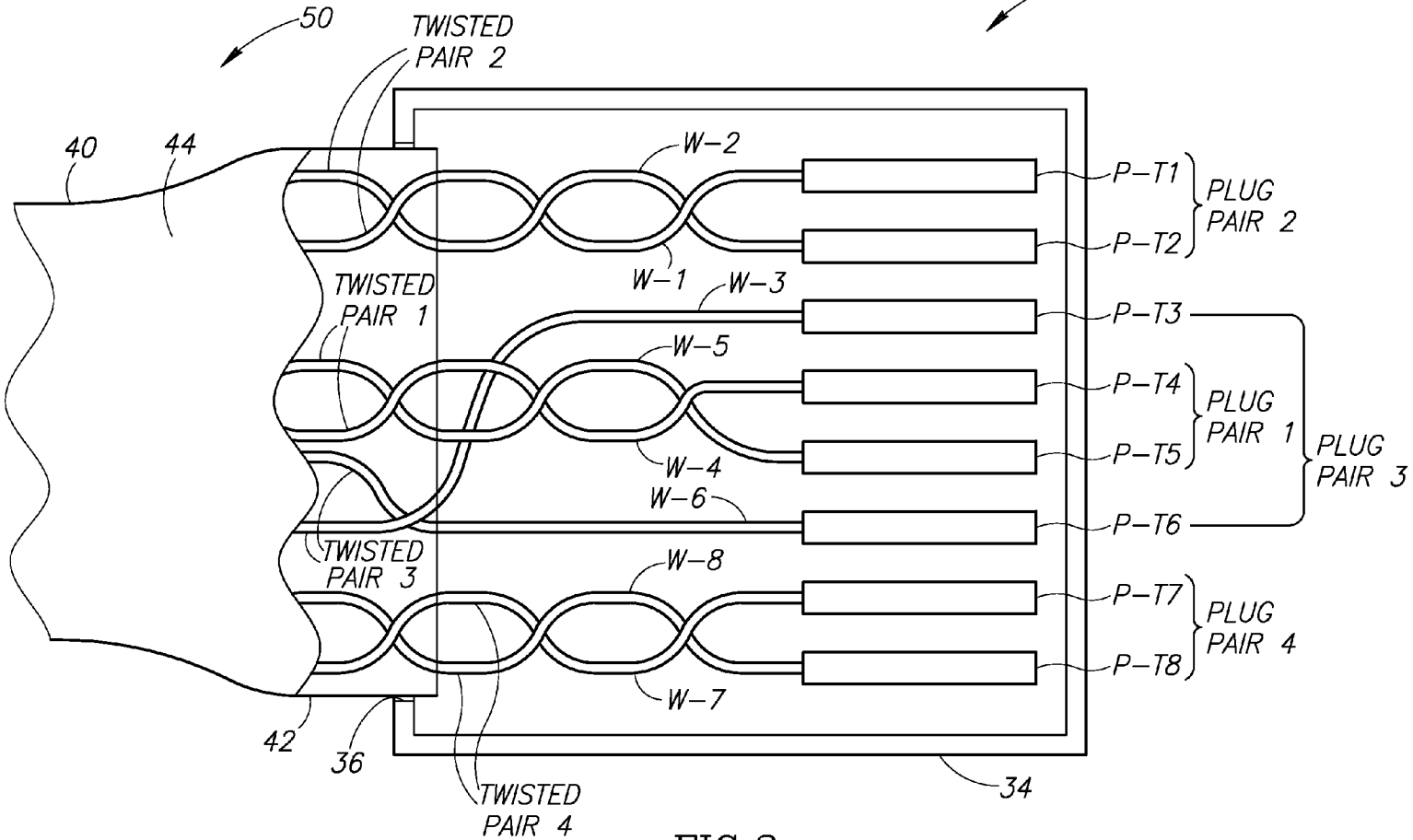
FIG. 3 (PRIOR ART)
FIG. 3 is a schematic showing internal components of the communication plug and the cable of FIG. 2.

FIGS. 1-3 illustrate the typical RJ-45 type plug 20, which is widely used in high speed data communication networks. Unfortunately, as explained in the Background Section, the prior art plug 20 has technical drawbacks that negatively affect its performance. These drawbacks may be particularly problematic in I0 Gigabit Ethernet applications. One such drawback is the tendency of the plug 20 to induce common mode signals in some circuits. These common mode signals may cause alien crosstalk within a communication system. As explained above, these common mode signals are caused by the physical arrangement of the plug contacts P-T1 to P-T8 and their associated wires W-1 to W-8, respectively, inside the plug 20. This arrangement creates an unequal physical and therefore electrical exposure of some circuits to others within the plug 20. The mechanism by which alien crosstalk is caused by these common mode signals has been described in the Background Section and pending U.S. patent application Ser. No. 12/401,587, filed Mar. 10, 2009, which is incorporated herein in its entirety by reference.

Figure 5:
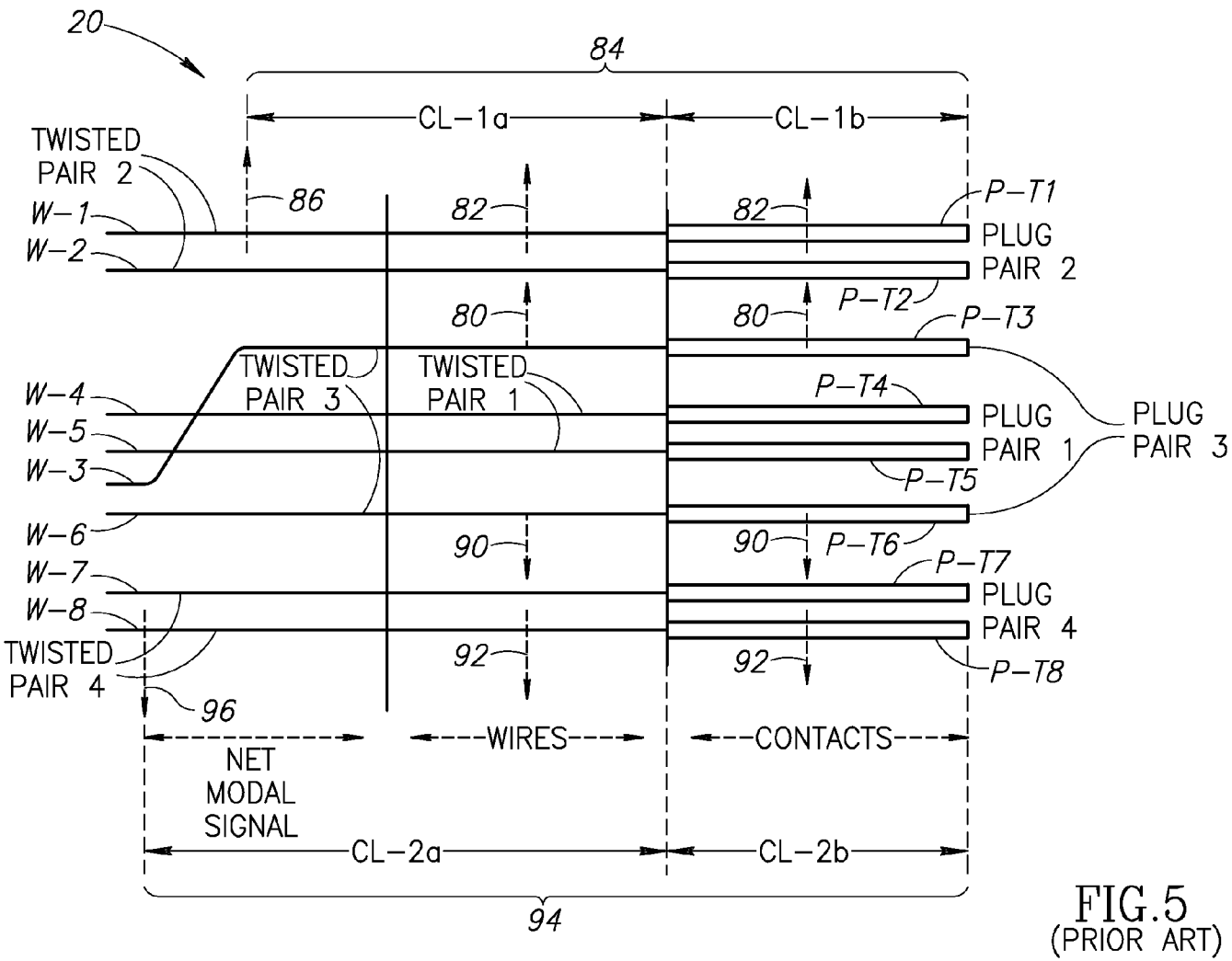
FIG.5 (PRIOR ART)
FIG. 5 is a vector diagram illustrating signals carried on the wires of a third "split" pair of wires within the prior art communication plug of FIG. 2 and common mode signals induced on a second pair of wires and a fourth pair of wires within the communication plug that may travel into the cable.

FIG. 5 provides a vector representation of common mode signals in the conventional RJ-45 plug 20. As explained in the Background Section, an unequal physical/electrical exposure of the wire W-3, and its associated plug contact P-T3, to the first "composite" wire (i.e., the wires W-I and W-2), and associated plug contacts P-T1 and P-T2, causes common mode signals to be induced in the first "composite" wire by the wire W-3.

Inside the plug 20, signals 80 transmitted by the wire W-3 induce common mode signals 82 on the first "composite" wire (i.e., the wires W-I and W-2) along a first coupling region 84 whereat the wire W-3 is untwisted from the wire W-6 and adjacent the first "composite" wire and the plug contact P-T3 is adjacent the plug contacts P-T1 and P-T2. A first portion of the first coupling region 84 where the wire W-3 is adjacent the first "composite" wire has a length "CL-1*a*." A second portion of the first coupling region 84 where the plug contact P-T3 is adjacent the plug contacts P-T1 and P-T2 has a length "CL-1*b*." Thus, the first coupling region 84 has a length equal to a sum of the lengths "CL-1*a*" and "CL-1*b*." The common mode signals 82 increase in magnitude along the length "CL-1*a*" away from the plug contacts P-T1 to P-T8. Therefore, the longer the length "CL-1*a*" of the first portion of the first coupling region 84, the greater the magnitude of the common mode signals 82 induced on the first "composite" wire (i.e., the wires W-I and W-2). The common mode signals 82 coupled to the wires W-1 and W-2, as described above, add to the common mode signals that are inherently introduced by the plug contacts P-T1, P-T2, and P-T3 and their arrangement inside the plug 20. Common mode signals 86 leave the plug 20 via the wires W-I and W-2 and may enter a system (not shown), a device (not shown), or the like connected to the plug 20.

Similarly, an unequal physical/electrical exposure of the wire W-6, and its associated plug contact P-T6, to the second "composite" wire (i.e., the wires W-7 and W-8), and their associated plug contacts P-T7 and P-T8, cause common mode signals to be induced in the second "composite" wire by the wire W-6. Thus, inside the plug 20, signals 90 transmitted by the wire W-6, induce common mode signals 92 on the second "composite" wire (i.e., the wires W-7 and W-8) along a second coupling region 94 whereat the wire W-6 is untwisted from the wire W-3 and adjacent the second "composite" wire and the plug contact P-T6 is adjacent the plug contacts P-T7 and P-T8. A first portion of the second coupling region 94 where the wire W-6 is adjacent the second "composite" wire has a length "CL-2*a*." A second portion of the second coupling region 94 where the plug contact P-T6 is adjacent the plug contacts P-T7 and P-T8 has a length "CL-2*b*.". Thus, the second coupling region 94 has a length equal to a sum of the lengths "CL-2*a*" and "CL-2*b*." The common mode signals 92 increase in magnitude along the length "CL-2*a*" away from the plug contacts P-T1 to P-T8. Therefore, the longer the length "CL-2*a*" of the first portion of the second coupling region 94, the greater the magnitude of the common mode signals 92 induced on the second "composite" wire (i.e., the wires W-7 and W-8). The common mode signals coupled to wires W-7 and W-8 as described above add to the common mode signals that are inherently introduced by the plug contacts P-T6, P-T7, and P-T8, and their arrangement inside the plug 20. Common mode signals 96 leave the plug 20 via the wires W-7 and W-8 and may enter a system (not shown), a device (not shown), or the like connected to the plug 20.

In the past, the common mode signals 82 and 92 were left un-countered, however recently some manufactures have developed plug and/or outlet designs that compensate for these common mode signals and thus reduce alien crosstalk ("ANEXT") caused by modal conversion.

Figure 4:
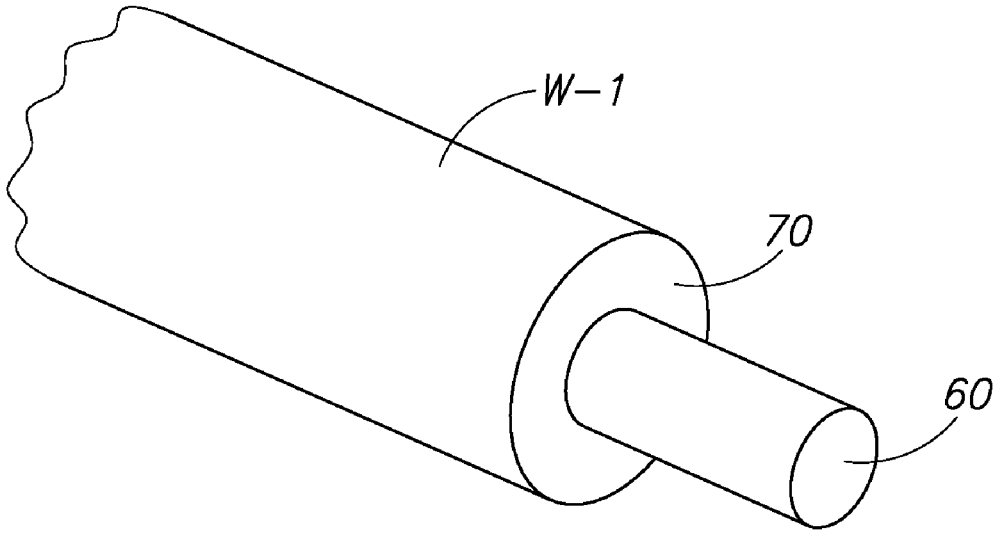
FIG.4 (PRIOR ART)
FIG. 4 is a fragmentary enlarged view of a wire of the cable of FIG. 3.

FIG. 6 provides a schematic representation of a plug 100 having reduced modal conversion. Like reference numerals have been used to identify like components in FIGS. 3 and 6. The plug 100 includes the housing 34 having the rearward facing open portion 36, and the plug contacts P-T1 to P-T8. The plug 100 is couplable to the end portion 42 of the cable 40, which includes the wires W-1 to W-8 arranged as the twisted pairs 1-4. Further, each of the wires W-1 to W-8 includes the electrical conductor 60 (see FIG. 4) surrounded by the outer layer of insulation 70 (see FIG. 4).

Inside the plug 100, the wires W-1 and W-2 of the twisted pair 2 are capacitively coupled to the wire W-6. Further, the wires W-7 and W-8 of the twisted pair 4 are capacitively coupled to the wire W-3. The capacitive coupling of the wires W-1 and W-2 of the twisted pair 2 to the wire W-6 is illustrated by capacitor plates "CP1," "CP2," and "CP3." The capacitor plate "CP1" is electrically connected to the wire W-1, the capacitor plate "CP2" is electrically connected to the wire W-2, and the capacitor plate "CP3" is electrically connected to the wire W-6. The capacitor plates "CP1" and "CP2" are opposite the capacitor plate "CP3." Thus, the capacitor plates "CP1" and "CP2" share the capacitor plate "CP3." Together, the capacitor plates "CP1," "CP2," and "CP3" form a first capacitive compensating circuit 120.

The capacitive coupling of the wires W-7 and W-8 of the twisted pair 4 to the wire W-3 is illustrated by capacitor plates "CP4," "CP5," and "CP6." The capacitor plate "CP4" is electrically connected to the wire W-7, the capacitor plate "CP5" is electrically connected to the wire W-8, and the capacitor plate "CP6" is electrically connected to the wire W-3. The capacitor plates "CP4" and "CP5" are opposite the capacitor plate "CP6." Thus, the capacitor plates "CP4" and "CP5" share the capacitor plate "CP6." Together, the capacitor plates "CP4," "CP5," and "CP6" form a second capacitive compensating circuit 122.

Turning to FIG. 7, an exemplary implementation of the plug 100 is illustrated. FIG. 7 depicts a plug 200 configured in compliance with the RJ-45 plug standard. Like reference numerals have been used to identify like components in FIGS. 3 and 7. The plug 200 includes the housing 34 having the rearward facing open portion 36, and the plug contacts P-T1 to P-T8. The plug 200 is couplable to the end portion 42 of the cable 40, which includes the wires W-1 to W-8 arranged as the twisted pairs 1-4. Further, each of the wires W-1 to W-8 includes the electrical conductor 60 (see FIG. 4) surrounded by the outer layer of insulation 70 (see FIG. 4).

A first coupling region 210*a* exists where the wire W-3 is untwisted from the wire W-6 and is adjacent to the first "composite" wire (i.e., the wires W-1 and W-2) and the plug contact P-T3 is adjacent the plug contacts P-T1 and P-T2. A first portion of the first coupling region 210*a* where the wire W-3 is adjacent to the first "composite" wire (i.e., the wires W-1 and W-2) has a length "CL-3*a*." A second portion of the first coupling region 210*a* where the plug contact P-T3 is adjacent the plug contacts P-T1 and P-T2 has a length "CL-3*b*." Thus, the length of the first coupling region 210*a* is equal to a sum of the lengths "CL-3*a*" and "CL-3*b*." Inside the plug 200, the first capacitive compensating circuit 120 (see FIG. 6) is implemented in part by a first electrically conductive sleeve 220 having an inside surface 221 and a length "L1." The first sleeve 220 is at least partially located inside the first coupling region 210*a*. In the embodiment illustrated, the first sleeve 220 is located within the first portion of the first coupling region 210*a*. The length "L1" of the first sleeve 220 may be equal to or less than the length "CL-3*a*" of the first portion of the first coupling region 210*a*. In the embodiment illustrated, the length "L1" of the first sleeve 220 is shorter than the length "CL-3*a*." By way of a non-limiting example, the length "L1" of the first sleeve 220 may be at least one quarter the length "CL-3*a*" of the first portion of the first coupling region 210*a*.

A portion W-1A and W-2A of each of the wires W-1 and W-2, respectively, of the twisted pair 2 extends through the first sleeve 220. Thus, the portions W-1A and W-2A each have lengths approximately equal to or greater than the length "L1" of the first sleeve 220. The portions W-1A and W-2A of the wires W-1 and W-2 located inside the first sleeve 220 may be twisted, untwisted, or a combination thereof.

The first sleeve 220 may be constructed from a sheet of a conductive material (e.g., copper foil) wrapped around the portions W-1A and W-2A. The first sleeve 220 extends around the portions W-1A and W-2A outside the outer layer of insulation 70 (see FIG. 4) of each of the wires W-1 and W-2. The first sleeve 220 is spaced apart from the plug contacts P-T1 and P-T2 by a first distance "D1." It may be desirable for the first distance "D1" to be large enough to avoid voltage breakdown problems.

Because common mode signals on the first "composite" wire in the first coupling region 210*a* are at least partially counteracted by the first sleeve 220, coupling between the wire W-3 and the wires W-1 and W-2 is limited to within a first shorter coupling region 210*b* that includes the plug contacts P-T1, P-T2, and P-T3. The first shorter coupling region 210*b* has a length that is less than that of the first coupling region 210*a* (i.e., the sum of the lengths "CL-3*a*" and "CL-3*b*"). The first shorter coupling region 210*b* includes the second portion of the first coupling region 210*a* and only the portion of the first portion of the first coupling region 210*a* that extends between the first sleeve 220 and the contacts P-T1 and P-T2. Thus, the first shorter coupling region 210*b* has a length equal to a sum of the first distance "D1" and the length "CL-3*b*."

A second coupling region 212*a* exists where the wire W-6 is untwisted from the wire W-3 and is adjacent to the second "composite" wire (i.e., the wires W-7 and W-8) and the plug contact P-T6 is adjacent the plug contacts P-T7 and P-T8. A first portion of the second coupling region 212*a* where the wire W-6 is adjacent to the second "composite" wire has a length "CL-4*a*." A second portion of the second coupling region 212*a* where the plug contact P-T6 is adjacent the plug contacts P-T7 and P-T8 has a length "CL-4*b*." Thus, the length of the second coupling region 212*a* is equal to a sum of the lengths "CL-4*a*" and "CL-4*b*."

Inside the plug 200, the second capacitive compensating circuit 122 (see FIG. 6) is implemented in part by a second electrically conductive sleeve 222 having an inside surface 223 and a length "L2." The second sleeve 222 is at least partially located inside the second coupling region 212*a*. The length "L2" of the second sleeve 222 may be equal to or less than the length "CL-4*a*" of the second coupling region 212*a*. In the embodiment illustrated, the second sleeve 222 is located within the first portion of the second coupling region 212*a*. In the embodiment illustrated, the length "L2" of the second sleeve 222 is shorter than the length "CL-4*a*." By way of a non-limiting example, the length "L2" of the second sleeve 222 may be at least one quarter the length "CL-4*a*."

A portion W-7A and W-8A of each of the wires W-7 and W-8, respectively, of the twisted pair 4 extends through the second sleeve 222. Thus, the portions W-7A and W-8A each have lengths approximately equal to or greater than the length "L2" of the second sleeve 222. The portions W-7A and W-8A of the wires W-7 and W-8 located inside the second sleeve 222 may be twisted, untwisted, or a combination thereof.

The second sleeve 222 may be constructed from a second sheet of a conductive material (e.g., copper foil) wrapped around the portions W-7A and W-8A. The second sleeve 222 extends around the portions W-7A and W-8A outside the outer layer of insulation 70 (see FIG. 4) of each of the wires W-7 and W-8. The second sleeve 222 is spaced apart from the plug contacts P-T7 and P-T8 by a second distance "D2." It may be desirable for the second distance "D2" to be large enough to avoid voltage breakdown problems.

Because common mode signals on the second "composite" wire in the second coupling region 212*a* are at least partially counteracted by the second sleeve 222, coupling between the wire W-6 and the wires W-7 and W-8 is limited to within a second shorter coupling region 212*b* that includes the plug contacts P-T6, P-T7, and P-T8. The second shorter coupling region 212*b* has a length that is less than that of the second coupling region 212*a* (i.e., the sum of the lengths "CL-4*a*" and "CL-4*b*"). The second shorter coupling region 212*b* includes the second portion of the second coupling region 212*a* and only the portion of the first portion of the second coupling region 212*a* that extends between the second sleeve 222 and the contacts P-T7 and P-T8. Thus, the second shorter coupling region 212*b* has a length equal to a sum of the second distance "D2" and the length "CL-4*b*."

The first sleeve 220 is electrically connected to the wire W-6. In the embodiment illustrated, the first sleeve 220 is electrically connected to wire W-6 by a first electrical conductor 230 (e.g., an interconnect wire) that extends through the outer layer of insulation 70 (see FIG. 4) of the wire W-6 and is in direct contact with the electrical conductor 60 (see FIG. 4). Thus, inside the plug 200, the first capacitive compensating circuit 120 (see FIG. 6) is implemented in part by the first sleeve 220 and in part by the first electrical conductor 230 (e.g. an interconnect wire). In other words, the first sleeve 220 and the first electrical conductor 230 together capacitively couple the wires W-1 and W-2 to the wire W-6 in a manner similar to that illustrated in FIG. 6 by the capacitor plates "CP1," "CP2," and "CP3." However, the first sleeve 220 and the first electrical conductor 230 do not inductively couple the wires W-1 and W-2 to the wire W-6.

The second sleeve 222 is electrically connected to the wire W-3. In the embodiment illustrated, the second sleeve 222 is electrically connected to the wire W-3 by a second electrical conductor 232 (e.g., an interconnect wire) that extends through the outer layer of insulation 70 (see FIG. 4) of the wire W-3 and is in direct contact with the electrical conductor 60 (see FIG. 4). Thus, inside the plug 200, the second capacitive compensating circuit 122 (see FIG. 6) is implemented in part by the second sleeve 222 and in part by the second electrical conductor 232. In other words, the second sleeve 222 and the second electrical conductor 232 together capacitively couple the wires W-7 and W-8 to the wire W-3 in a manner similar to that illustrated in FIG. 6 by the capacitor plates "CP4," "CP5," and "CP6." However, the second sleeve 222 and the second electrical conductor 232 do not inductively couple the wires W-7 and W-8 to the wire W-3.

Thus, the first sleeve 220 and the first electrical conductor 230 capacitively couple the wires W-1 and W-2 to the wire W-6 without inductively coupling the wires W-1 and W-2 to the wire W-6. Similarly, the second sleeve 222 and the second electrical conductor 232 capacitively couple the wires W-7 and W-8 to the wire W-3 without inductively coupling the wires W-7 and W-8 to the wire W-3. As used herein, the phrase "without inductively coupling" means substantially no inductive coupling. In other words, as is appreciated by those of ordinary skill in the art, depending upon the implementation details, an insubstantial or insignificant amount of inductive coupling may be present.

Table A below shows the approximate total coupling capacitance of the first "composite" wire (i.e., the wires W-1 and W-2) to the first sleeve 220 for different values of the length "L1." The values in Table A are based on the first sleeve 220 being closely coupled to the wires W-1 and W-2 (e.g., when the inside surface 221 of first sleeve 220 is placed directly on the outer layer of insulation 70 (see FIG. 4) of the wires W-1 and W-2).

TABLE A

| Length "L1" (inches) | Approximate total coupling capacitance of the first "composite" wire (i.e., the wires W-1 and W-2) to the first sleeve 220 (pF) |
|---|---|
| 0.005 | 0.140 |
| 0.010 | 0.182 |
| 0.200 | 1.530 |
| 0.250 | 1.850 |
| 0.300 | 2.200 |

TABLE B

| Length "L2" (inches) | Approximate total coupling capacitance of the second "composite" wire (i.e., the wires W-7 and W-8) to the second sleeve 222 (pF) |
|---|---|
| 0.005 | 0.140 |
| 0.010 | 0.182 |
| 0.200 | 1.530 |
| 0.250 | 1.850 |
| 0.300 | 2.200 |

Table B above shows the approximate total coupling capacitance of the second "composite" wire (i.e., the wires W-7 and W-8) to the second sleeve 222 for different values of the length "L2." The values in Table B are based on the second sleeve 222 being closely coupled to the wires W-7 and W-8 (e.g., when the inside surface 223 of second sleeve 222 is placed directly on the outer layer of insulation 70 (see FIG. 4) of the wires W-7 and W-8).

According to the data in Table A, the first sleeve 220, which may be characterized as a coupling plate for providing modal compensation, provides a useful improvement when the length "D" is within a first range of about 5 mils (i.e., about 0.005 inches) to about 300 mils (i.e., about 0.300 inches). Similarly, according to the data in Table B, the second sleeve 222, which may be characterized as a modal coupling shield, provides a useful improvement when the length "L2" is within a second range of about 5 mils (i.e., about 0.005 inches) to about 300 mils (i.e., about 0.300 inches). It is believed that optimal modal improvement may fall within the first and second ranges.

In the embodiment illustrated, to help prevent high voltage breakdown problems, it may be beneficial for each of the distances "D1" and "D2" to be approximately 25 mils (i.e., about 0.025 inches). However, the distances "D1" and "D2" could be larger to accommodate manufacturability of the first and second sleeves 220 and 222 and/or other aspects of the plug 200. Alternatively, the distances "D1" and "D2" could be smaller if a dielectric insulator (not shown) is used between the plug contacts P-T1 to P-T8 and the sleeves 220 and 222.

FIG. 8 provides a vector representation of common mode signals in the plug 200, which as explained above, has been configured to provide capacitive modal compensation. Inside the plug 200, signals 240 travelling on the wire W-3, and its associated plug contact P-T3, induce common mode signals 242 on the first "composite" wire (i.e., the wires W-I and W-2), and associated contacts P-T1 and P-T2, along the first shorter coupling region 210*b*. Similarly, signals 250 travelling on the wire W-6, and its associated contact P-T6, induce common mode signals 252 on the second "composite" wire (i.e., the wires W-7 and W-8), and associated contacts P-T7 and P-T8), along the second shorter coupling region 212*b*.

The longer the length "CL-3*a*" of the first portion of the first coupling region 210*a*, the greater the magnitude of the common mode signals 242 induced on the first "composite" wire (i.e., the wires W-I and W-2). However, because within the plug 200 coupling between the wire W-3 and the wires W-1 and W-2 is limited to within the first shorter coupling region 210*b*, the magnitude of the common mode signals 242 is reduced. Similarly, the longer the length "CL-4*a*" of the first portion of the second coupling region 212*a*, the greater the magnitude of the common mode signals 252 induced on the second "composite" wire (i.e., the wires W-7 and W-8). However, because within the plug 200 coupling between the wire W-6 and the wires W-7 and W-8 is limited to within the second shorter coupling region 212*b*, the magnitude of the common mode signals 252 is reduced.

The plug 200 is configured to at least partially compensate for, or cancel, the offending modal signals or common mode signals 242 and 252. Inside the plug 200, additional common mode signals 254 are generated on the first "composite" wire (i.e., the wires W-I and W-2 of the twisted pair 2), and additional common mode signals 256 are generated on the second "composite" wire (i.e., the wires W-7 and W-8 of the twisted pair 4). The additional common mode signals 254 and 256 are opposite in polarity to the offending common mode signals 242 and 252, respectively. Because the newly generated common mode signals 254 are opposite in polarity to the offending common mode signals 242, the two signals tend to cancel each other out thereby reducing the net common mode signals on the first "composite" wire. Similarly, because the newly generated common mode signals 256 are opposite in polarity to the offending common mode signals 252, the two signals tend to cancel each other out thereby reducing the net common mode signals on the second "composite" wire.

In the embodiment illustrated, common mode signals 258 may leave the plug 200 via the first "composite" wire. However, the magnitude of the common mode signals 258 that leave the plug 200 via the first "composite" wire is less than the magnitude of the common mode signals 86 (see FIG. 5) that leave the prior art plug 20 (see FIG. 5) via the first "composite" wire. Further, the magnitude of the common mode signals 259 that leave the plug 200 via the second "composite" wire is less than the magnitude of the common mode signals 96 (see FIG. 5) that leave the prior art plug 20 (see FIG. 5) via the second "composite" wire. By reducing the modal conversion in the plug 200, the amount of alien crosstalk occurring in the communication system caused by modal conversion may also be reduced.

Turning to FIG. 9, the first electrical conductor 230 may include an insulation displacement contact ("IDC") 260 configured to cut through the outer layer of insulation 70 (see FIG. 4) disposed about the electrical conductor 60 (see FIG. 4) of the wire W-6 to contact the electrical conductor directly thereby forming an electrical connection between the first electrical conductor 230 and the wire W-6. Similarly, the second electrical conductor 232 may include an IDC 262 configured to cut through the outer layer of insulation 70 (see FIG. 4) disposed about the electrical conductor 60 (see FIG. 4) of the wire W-3 to contact the electrical conductor directly thereby forming an electrical connection between the second electrical conductor 232 and the wire W-3.

FIG. 10 illustrates a capacitive coupling member 300 constructed from a single sheet 310 of electrically conductive material (e.g., beryllium copper, phosphorus bronze, and the like). The first capacitive compensating circuit 120 and/or the second capacitive compensating circuit 122 (both illustrated in FIG. 6) may be implemented using the capacitive coupling member 300. An exemplary embodiment of the sheet 310 before it is formed into the capacitive coupling member 300 is provided in FIG. 11.

Turning to FIG. 11, the sheet 310 has a first end portion 312, an intermediate portion 314, and a second end portion 320. The first end portion 312 has an outwardly extending IDC portion 322 that is substantially orthogonal to the intermediate portion 314. The IDC portion 322 has a free end portion 324 with a cutout or notch 326 formed therein. Turning to FIG. 12, the notch 326 of the IDC portion 322 is configured to receive one of the wires W-3 and W-6, slice through its outer layer of insulation 70, and contact the electrical conductor 60 to form an electrical connection between the IDC portion 322 and the wire.

Returning to FIG. 11, the second end portion 320 has a width "WIDTH-1." Optionally, the second end portion 320 has an outwardly extending sleeve portion 328 substantially orthogonal to the intermediate portion 314 that increases the width "WIDTH-1" of the second end portion 320. In the embodiment illustrated, the IDC portion 322 and the sleeve portion 328 extend outwardly from the intermediate portion 314 in the same direction. However, this is not a requirement and embodiments in which the IDC portion 322 and the sleeve portion 328 extend outwardly from the intermediate portion 314 in different directions are also within the scope of the present teachings.

Returning to FIG. 10, the second end portion 320 of the sheet 310 is rolled into a loop 322 to form a conductive sleeve 330 having a length "L3" equal to the width "WIDTH-1" of the second end portion 320. Depending upon the implementation details, the loop 322 need not be completely closed. The IDC portion 322 may be bent relative to the intermediate portion 314 in the same direction in which the first end portion 320 is rolled to form the sleeve 330. Alternatively, the IDC portion 322 may be bent relative to the intermediate portion 314 in a direction opposite that in which the first end portion 320 is rolled to form the sleeve 330. In the embodiment illustrated, the IDC portion 322 is bent relative to the intermediate portion 314 such that the IDC portion 322 is substantially orthogonal to the intermediate portion 314.

As illustrated in FIG. 12, the first electrically conductive sleeve 220 (see FIG. 9) and the first electrical conductor 230 (see FIG. 9) may be implemented using a first capacitive coupling member 300A. Similarly, the second electrically conductive sleeve 222 (see FIG. 7) and the second electrical conductor 232 (see FIG. 7) may be implemented using a second capacitive coupling member 300B. In this embodiment, the portions W-1A and W-2A of the wires W-1 and W-2, respectively, are received inside the sleeve 330 of the first capacitive coupling member 300A and the portions W-7A and W-8A of the wires W-7 and W-8, respectively, are received inside the sleeve 330 of the second capacitive coupling member 300B.

A portion of the wire W-6 is received inside the notch 326 of the IDC portion 322 of the first capacitive coupling member 300A, which slices through its outer layer of insulation 70, and contacts the electrical conductor 60 to form an electrical connection between the first capacitive coupling member 300A and the wire W-6. A portion of the wire W-3 is received inside the notch 326 of the IDC portion 322 of the second capacitive coupling member 300B, which slices through its outer layer of insulation 70, and contacts the electrical conductor 60 to form an electrical connection between the second capacitive coupling member 300B and the wire W-3.

Turning to FIG. 13, the first and second capacitive coupling members 300A and 300B may be incorporated into a wire management device 400. The wire management device 400 may include a two-piece housing 410 having an open first end portion 412 opposite an open second end portion 414. In particular embodiments, the housing 410 may be approximately 0.2 inches from the open first end portion 412 to the open second end portion 414. However, this is not a requirement. The two-piece housing 410 includes an open ended outer cover portion 420 and an open ended inner nested portion 422. Each of the outer cover portion 420 and the inner nested portion 422 has a generally U-shaped cross-sectional shape.

The outer cover portion 420 has a first sidewall 424 spaced apart from a second sidewall 426 and a transverse wall 428 connecting the first and second sidewalls together. Distal portions 430 and 432 of the first and second sidewalls 424 and 426, respectively, are spaced from the transverse wall 428.

The inner nested portion 422 has a first sidewall 434 spaced apart from a second sidewall 436. The first sidewall 434 has a first proximal portion 435 and the second sidewall 436 has a second proximal portion 437. A transverse wall 438 connects the first proximal portion 435 of the first sidewall 434 to the second proximal portion 437 of the second sidewall 436. The first proximal portion 435 extends outwardly and upwardly away from the transverse wall 438 to define a first side channel 440 adjacent the intersection of the first sidewall 434 and the transverse wall 438. The second proximal portion 437 extends outwardly and upwardly away from the transverse wall 438 to define a second side channel 442 adjacent the intersection of the second sidewall 436 and the transverse wall 438. The transverse wall 438 has an inwardly facing surface 450.

In the embodiment illustrated, the inner nested portion 422 is configured to be at least partially received inside the outer cover portion 420 between the first and second sidewalls 424 and 426. Further, the inner nested portion 422 and the outer cover portion 420 are configured to be snapped together. As the inner nested portion 422 is at least partially received inside the outer cover portion 420, the distal portions 430 and 432 of the first and second sidewalls 424 and 426, respectively, are temporarily displaced outwardly. At the same time, the first and second sidewalls 434 and 436 of the inner nested portion 422 are temporarily displaced inwardly. This continues to occur until the distal portions 430 and 432 are positioned inside the side channels 440 and 442, respectively, at which time, both sidewalls 424 and 426 and their associated distal portions 430 and 432 return to their normal (non-displaced) positions to join the upper and lower portions 420 and 422 of the wire management device 400 together. At which time, the first and second sidewalls 434 and 436 of the inner nested portion 422 may also return to their normal (non-displaced) positions. Thus, the outer cover portion 420 and the inner nested portion 422 may be joined together to prevent the disengagement of the inner nested portion 422 from the outer cover portion 420. By way of a non-limiting example, the outer cover portion 420 and the inner nested portion 422 may be joined together using a conventional pair of pipe pliers or similar mechanical device configured to apply the force required to press the outer cover portion 420 and the inner nested portion 422 of the wire management device 400 together.

It is understood that the wire management device 400 described above is only one example of how such a device might be implemented.

The first and second capacitive coupling members 300A and 300B may be positioned inside the inner nested portion 422. In such embodiments, one of the first and second capacitive coupling members 300A and 300B is positioned with its intermediate portion 314 resting upon the inwardly facing surface 450 of the transverse wall 438 of the inner nested portion 422. In the embodiment illustrated, the second capacitive coupling member 300B is in this upright orientation. In this orientation, the sleeve 330 and the IDC portion 322 each extend upwardly away from the inwardly facing surface 450 of the transverse wall 438 of the inner nested portion 422.

The other of the first and second capacitive coupling members 300A and 300B is in an inverted orientation that positions its sleeve 330 adjacent the inwardly facing surface 450 of the transverse wall 438 of the inner nested portion 422 and spaces its intermediate portion 314 away from the inwardly facing surface 450. In the embodiment illustrated, the first capacitive coupling member 300A is positioned in the inverted orientation. In the inverted orientation, the sleeve 330 and the IDC portion 322 each extend downwardly toward the inwardly facing surface 450.

As may best be viewed in FIG. 12, the first and second capacitive coupling members 300A and 300B may be positioned such that the IDC portion 322 of the second capacitive coupling member 300B is adjacent to the sleeve 330 the first capacitive coupling member 300A. Further, the IDC portion 322 of the first capacitive coupling member 300A may be positioned adjacent to sleeve 330 of the second capacitive coupling member 300B. When arranged in this manner, a central channel 460 is defined between the intermediate portion 314 of the first capacitive coupling member 300A, the intermediate portion 314 of the second capacitive coupling member 300B, the IDC portion 322 of the first capacitive coupling member 300A, and the IDC portion 322 of the second capacitive coupling member 300B.

The first capacitive coupling member 300A is positioned to receive the wires W-1 and W-2 inside the sleeve 330 and position the notch 326 adjacent the wire W-6. The second capacitive coupling member 300B is positioned to receive the wires W-7 and W-8 inside the sleeve 330 and position the notch 326 adjacent the wire W-3. The central channel 460 is positioned to receive the wires W-4 and W-5.

The wire management device 400 may be used to construct a plug assembly, such as a plug assembly 500 illustrated in FIG. 15, and the like, that includes capacitive modal compensation without inductive modal compensation. Plug assembly 500 includes both the plug 20 and the wire management device 400. Referring to FIG. 14, to construct the plug assembly 500 (illustrated in FIG. 15), and terminate the plug 20 on the end portion 42 of the cable 40, a predetermined amount (e.g., approximately two inches) of the outer cable sheath 44 is removed from the end portion 42 of the cable 40 to expose the insulated wires W-1 to W-8.

Then, the wires W-1 to W-8 are positioned inside the inner nested portion 422 of the wire management device 400. Specifically, the wires W-1 and W-2 are positioned inside the sleeve 330 of the first capacitive coupling member 300A; the wire W-6 is positioned adjacent to the notch 326 (see FIG. 13) of the first capacitive coupling member 300A; the wires W-7 and W-8 inside the sleeve 330 of the second capacitive coupling member 300B; the wire W-3 is positioned adjacent to the notch 326 (see FIG. 13) of the second capacitive coupling member 300B; and the wires W-4 and W-5 are positioned inside the central channel 460 (see FIG. 12). The wires W-4 and W-5 of twisted pair 1, the wires W-1 and W-2 of twisted pair 2, and the wires W-7 and W-8 of twisted pair 4 may remain twisted together inside the wire management device 400 but the wires W-3 and W-6 of twisted pair 3 are untwisted and arranged to straddle the twisted pair 1.

Then, as illustrated in FIG. 12, the outer cover portion 420 is joined with the inner nested portion 422. The joining operation drives the wire W-3 onto the IDC portion 322 of the second capacitive coupling member 300B and the wire W-6 into the IDC portion 322 of the first capacitive coupling member 300A. The IDC portion 322 of the second capacitive coupling member 300B pierces the outer layer of insulation 70 of the wire W-3 skiving or cutting the outer layer of insulation 70 to form an electrical connection between the second capacitive coupling member 300B and the electrical conductor 60 of the wire W-3. At the same time, the IDC portion 322 of the first capacitive coupling member 300A pierces the outer layer of insulation 70 of the wire W-6 skiving or cutting the outer layer of insulation 70 to form an electrical connection between the first capacitive coupling member 300A and the electrical conductor 60 of the wire W-6. The joining operation also joins the outer cover portion 420 and the inner nested portion 422 together as described earlier. Depending upon the implementation details, the joining operation may permanently connect the outer cover portion 420 and the inner nested portion 422 together.

Next, referring to FIG. 15, to form the plug assembly 500, the wire management device 400 is inserted inside the housing 34 of the plug 20. Depending on the length "L3" of the sleeves 330 used, the wire management device 400 may extend outwardly from the rearwardly facing opening 36 of plug housing 34. However, this is not a requirement. The ends of the wires W-1 to W-8 exit the wire management device 400 through the open second end portion 414. The wire management device 400 positions the wires W-1 to W-8 in appropriate positions, ready to be accepted inside the plug 20 (e.g., a conventional RJ-45 type plug, such as a short body RJ-45 type plug) and connected to the plug contacts P-T1 to P-T8 (see FIG. 3). The pre-positioned wires W-1 to W-8 (see FIG. 14) are then connected to the plug contacts P-T1 to P-T8 (see FIG. 3), respectively, and the plug assembly 500 is then crimped together in a conventional manor which is well understood by those of ordinary skill in the art. Once assembled, the wire management device 400 may be considered an integral part of the housing 34.

EXPERIMENTAL RESULTS

A physical embodiment of the plug 200 (illustrated in FIG. 7) was constructed and compared with a conventional RJ-45 plug. The performance of the plugs was evaluated by measuring an amount of modal conversion occurring in each of the plugs. The lower the amount of modal conversion occurring in a particular plug, the lower the amount alien crosstalk due to modal conversion in the channel. FIG. 16 is a graph comparing the amount of modal conversion measured in a conventional RJ-45 plug and the modified plug 200 with capacitive but not inductive modal compensation. The dashed line is a plot of the amount of modal conversion measured in the conventional RJ-45 plug and the solid line is a plot of the amount of modal conversion measured in the physical embodiment of the plug 200. As illustrated in FIG. 16, the physical embodiment of the plug 200 exhibited considerably less modal conversion than the conventional plug. An approximate 10 dB improvement was measured from about 150 MHZ to about 500 MHZ.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A patch cable comprising:

a multi-wire cable comprising a first pair of twisted wires, a second pair of twisted wires, and a third pair of twisted wires, the third pair of twisted wires comprising a first wire and a second wire untwisted along an untwisted portion; and a plug comprising a capacitive coupling member, a first pair of plug contacts, a second pair of plug contacts, and a third pair of plug contacts, the third pair of plug contacts comprising a first plug contact and a second plug contact, the first pair of plug contacts being located between the first and second plug contacts of the third pair of plug contacts, the second pair of plug contacts being adjacent to the first plug contact of the third pair of plug contacts, the first pair of twisted wires being electrically connected to the first pair of plug contacts, the second pair of twisted wires being electrically connected to the second pair of plug contacts, the untwisted portion of the first wire of the third pair of twisted wires being electrically connected to the first plug contact of the third pair of plug contacts, and the untwisted portion of the second wire of the third pair of twisted wires being electrically connected to the second plug contact of the third pair of plug contacts to thereby position at least a portion of the first pair of twisted wires between the untwisted portions of the first and second wires of the third pair of twisted wires and at least a portion of the second pair of twisted wires adjacent the untwisted portion of the first wire of the third pair of twisted wires, the capacitive coupling member comprising a first portion capacitively coupled to at least a portion of the portion of the second pair of twisted wires adjacent the untwisted portion of the first wire of the third pair of twisted wires, and a second portion electrically connected to the second wire of the third pair of twisted wires.

2. The patch cable of claim 1, wherein the multi-wire cable comprises a first end portion opposite a second end portion, the plug is a first plug connected to the first end portion of the multi-wire cable, and the patch cable further comprises a second plug substantially identical to the first plug connected to the second end portion of the multi-wire cable.

3. The patch cable of claim 1, wherein the capacitive coupling member capacitively couples the portion of the second pair of twisted wires adjacent the untwisted portion of the first wire of the third pair of twisted wires with the second wire of the third pair of twisted wires without inductively coupling the portion of the second pair of twisted wires adjacent the untwisted portion of the first wire of the third pair of twisted wires with the second wire of the third pair of twisted wires.

4. The patch cable of claim 1, wherein the multi-wire cable further comprises a fourth pair of twisted wires; and the plug further comprises a second capacitive coupling member, and a fourth pair of plug contacts, the fourth pair of plug contacts being adjacent to the second plug contact of the third pair of plug contacts, and the fourth pair of twisted wires being electrically connected to the fourth pair of plug contacts to thereby position at least a portion of the fourth pair of twisted wires adjacent the untwisted portion of the second wire of the third pair of twisted wires, the second capacitive coupling member comprising a first portion capacitively coupled to at least a portion of the portion of the fourth pair of twisted wires adjacent the untwisted portion of the second wire of the third pair of twisted wires, and a second portion electrically connected to the first wire of the third pair of twisted wires.

5. The patch cable of claim 4, wherein the second capacitive coupling member capacitively couples the portion of the fourth pair of twisted wires adjacent the untwisted portion of the second wire of the third pair of twisted wires with the first wire of the third pair of twisted wires without inductively coupling the portion of the fourth pair of twisted wires adjacent the untwisted portion of the second wire of the third pair of twisted wires with the first wire of the third pair of twisted wires.

6. The patch cable of claim 1, wherein the plug is compliant with RJ-45 plug standards.

7. A method of constructing a plug and terminating a cable at the plug, the method comprising:

inserting first end portions of a first pair of wires into the plug;

electrically connecting the first end portions of the first pair of wires to a first pair of plug contacts;

inserting first end portions of a second pair of wires into the plug;

positioning coupling portions of the second pair of wires inside a first electrically conductive sleeve, the coupling portions being spaced apart from the first end portions of the second pair of wires;

electrically connecting the first end portions of the second pair of wires to a second pair of plug contacts;

inserting first end portions of a third pair of wires into the plug;

electrically connecting the first end portion of a first wire of the third pair of wires to a first plug contact of a third pair of plug contacts, the second pair of plug contacts being positioned alongside the first plug contact of the third pair of plug contacts;

electrically connecting the first end portion of a second wire of the third pair of wires to a second plug contact of the third pair of plug contacts, the first pair of plug contacts being located between the first and second plug contacts of the third pair of plug contacts;

electrically connecting the second wire of the third pair of wires to the first electrically conductive sleeve to thereby capacitively couple the second pair of wires with the second wire of the third pair of wires; and inserting first end portions of a fourth pair of wires into the plug; and electrically connecting the first end portions of the fourth pair of wires to a fourth pair of plug contacts, the fourth pair of plug contacts being positioned alongside the second plug contact of the third pair of plug contacts.

8. The method of claim 7, further comprising:

positioning coupling portions of the fourth pair of wires inside a second electrically conductive sleeve, the coupling portions of the fourth pair of wires being spaced apart from the first end portions of the fourth pair of wires; and electrically connecting the first wire of the third pair of wires to the second electrically conductive sleeve to thereby capacitively couple the fourth pair of wires with the first wire of the third pair of wires.

9. The method of claim 8, further comprising:

positioning the first and second electrically conductive sleeves inside a housing comprising a first open end and a second open end; and positioning a portion of each of the first, second, third, and fourth pairs of wires inside the housing, with the coupling portions of the second pair of wires being positioned inside the first electrically conductive sleeve and the coupling portions of the fourth pair of wires being positioned inside the second electrically conductive sleeve, the first end portions of the first, second, third, and fourth pairs of wires extending outwardly from the housing through the second open end, and second end portions of the first, second, third, and fourth pairs of wires extending outwardly from the housing through the first open end.

10. The method of claim 9, further comprising inserting the housing inside the plug thereby positioning the first end portions of the first, second, third, and fourth pairs of wires extending outwardly from the housing through the second open end inside the plug.

11. The method of claim 9, further comprising positioning the housing adjacent to an opening in the plug; and inserting the first end portions of the first, second, third, and fourth pairs of wires extending outwardly from the second open end of the housing inside the opening of the plug.

12. The method of claim 8, further comprising:

positioning the first and second electrically conductive sleeves inside a lower housing portion comprising a first open end and a second open end;

positioning a portion of each of the first, second, third, and fourth pairs of wires inside the lower housing portion, with the coupling portions of the second pair of wires being positioned inside the first electrically conductive sleeve and the coupling portions of the fourth pair of wires being positioned inside the second electrically conductive sleeve, the first end portions of the first, second, third, and fourth pairs of wires extending outwardly from the lower housing portion through the second open end, and second end portions of the first, second, third, and fourth pairs of wires extending outwardly from the lower housing portion through the first open end; and attaching an upper housing portion to the lower housing portion.

13. The method of claim 12, wherein attaching the upper housing portion to the lower housing portion comprises joining one of the upper housing portion and the lower housing portion to the other.

* * * * *